US008897677B2

(12) United States Patent
Takashima

(10) Patent No.: US 8,897,677 B2
(45) Date of Patent: Nov. 25, 2014

(54) DEVELOPER TRANSPORTING DEVICE AND IMAGE FORMING APPARATUS

(75) Inventor: Yoshiyuki Takashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 196 days.

(21) Appl. No.: 13/458,656

(22) Filed: Apr. 27, 2012

(65) Prior Publication Data

US 2013/0121731 A1 May 16, 2013

(30) Foreign Application Priority Data

Nov. 16, 2011 (JP) ..... 2011-250308

(51) Int. Cl.
*G03G 15/08* (2006.01)

(52) U.S. Cl.
CPC ..... *G03G 15/0886* (2013.01); *G03G 15/0837* (2013.01)
USPC ..... 399/258

(58) Field of Classification Search
CPC ..... G03G 13/06
USPC ..... 399/258
See application file for complete search history.

(56) References Cited

U.S. PATENT DOCUMENTS 6,564,029 B2 * 5/2003 Kojima et al. ..... 399/258
2002/0034404 A1 * 3/2002 Kojima et al. ..... 399/258
2006/0291909 A1 * 12/2006 Park ..... 399/258
2010/0247160 A1 * 9/2010 Ohta et al. ..... 399/262
2011/0052266 A1 * 3/2011 Yoon et al. ..... 399/258

FOREIGN PATENT DOCUMENTS

JP 2005-134452 A 5/2005
JP 2008-129357 A 6/2008

OTHER PUBLICATIONS

Machine translation of Takahashi, JP 2005134452 A, publication date: May 26, 2006.*

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

A developer transporting device includes a transporting device body having an inlet, an inlet cover member that opens and closes the inlet, a container having an outlet, an outlet cover member that opens and closes the outlet, a restraining member that restrains an opening movement of the inlet cover member, and a releasing member that is capable of releasing the inlet cover member from the state in which the opening movement is restrained. The restraining member restrains the opening movement of the inlet cover member when the outlet cover member is closed. The releasing member releases the inlet cover member from the state in which the opening movement is restrained when the outlet cover member is open.

14 Claims, 14 Drawing Sheets

DEVELOPER TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2011-250308 filed Nov. 16, 2011.

BACKGROUND (i) Technical Field

The present invention relates to a developer transporting device and an image forming apparatus.

(ii) Related Art

An example of an electrophotographic image forming apparatus includes a container that contains developer to be supplied and consumed in an image forming operation and a container into which developer discharged in the image forming apparatus is collected. The containers are generally replaceable and are detachably attached to the image forming apparatus.

SUMMARY

According to an aspect of the invention, there is provided a developer transporting device including a transporting device body having an inlet through which developer is supplied to the transporting device body, an inlet cover member that opens and closes the inlet, a container having an outlet through which developer contained in the container is discharged, the container being detachably supported by the transporting device body, an outlet cover member that opens and closes the outlet, a restraining member that is provided on the transporting device body and that restrains an opening movement of the inlet cover member, and a releasing member that is provided on the container and that is capable of releasing the inlet cover member from the state in which the opening movement is restrained. The restraining member restrains the opening movement of the inlet cover member when the outlet cover member is closed. The releasing member releases the inlet cover member from the state in which the opening movement is restrained when the outlet cover member is open.

BRIEF DESCRIPTION OF THE DRAWINGS

An exemplary embodiment of the present invention will be described in detail based on the following figures, wherein:

FIGS. 11A and 11B illustrate the states of the main-body shutter, an inlet, the main-body-shutter lock, the cartridge inner shutter, the inner-shutter support, a cartridge contact portion, a releasing rib, and a container shutter lock in the process of attaching the cartridge according to the exemplary embodiment to the main body, wherein FIG. 11A illustrates the state in which the cartridge is separated from the main body and FIG. 11B illustrates the state in which the cartridge is inserted from the state illustrated in FIG. 11A to the state in which the cartridge inner shutter is in contact with the container shutter lock;

FIGS. 12A and 12B illustrate the states after the states in FIGS. 11A and 11B, wherein FIG. 12A illustrates the state in which the cartridge is further inserted from the state illustrated in FIG. 11B and the cartridge contact portion is in contact with a main-body contact portion and FIG. 12B illustrates the state in which the cartridge is further inserted from the state illustrated in FIG. 12A and the cartridge contact portion is placed in the main-body contact portion;

FIGS. 13A and 13B illustrate the states after the states in FIGS. 12A and 12B, wherein FIG. 13A illustrates the state in which the cartridge is further inserted from the state illustrated in FIG. 12B and the insertion of the cartridge is completed, and FIG. 13B illustrates the state in which the cartridge is pulled outward from the state illustrated in FIG. 13A and deformation of the main-body contact portion is suppressed.

DETAILED DESCRIPTION

An exemplary embodiment of the present invention will be described with reference to the drawings. However, the present invention is not limited to the following exemplary embodiment.

To facilitate understanding of the following descriptions, the front-back direction, the left-right direction, and the up-down direction are defined as the X-axis direction, the Y-axis direction, and the Z-axis direction, respectively, in each figure. In addition, directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "x" marks therein show the direction from front to back with respect to the sides illustrated in the figures.

In each figure, components other than those necessary for the explanations are omitted to facilitate understanding.

Figure 1:
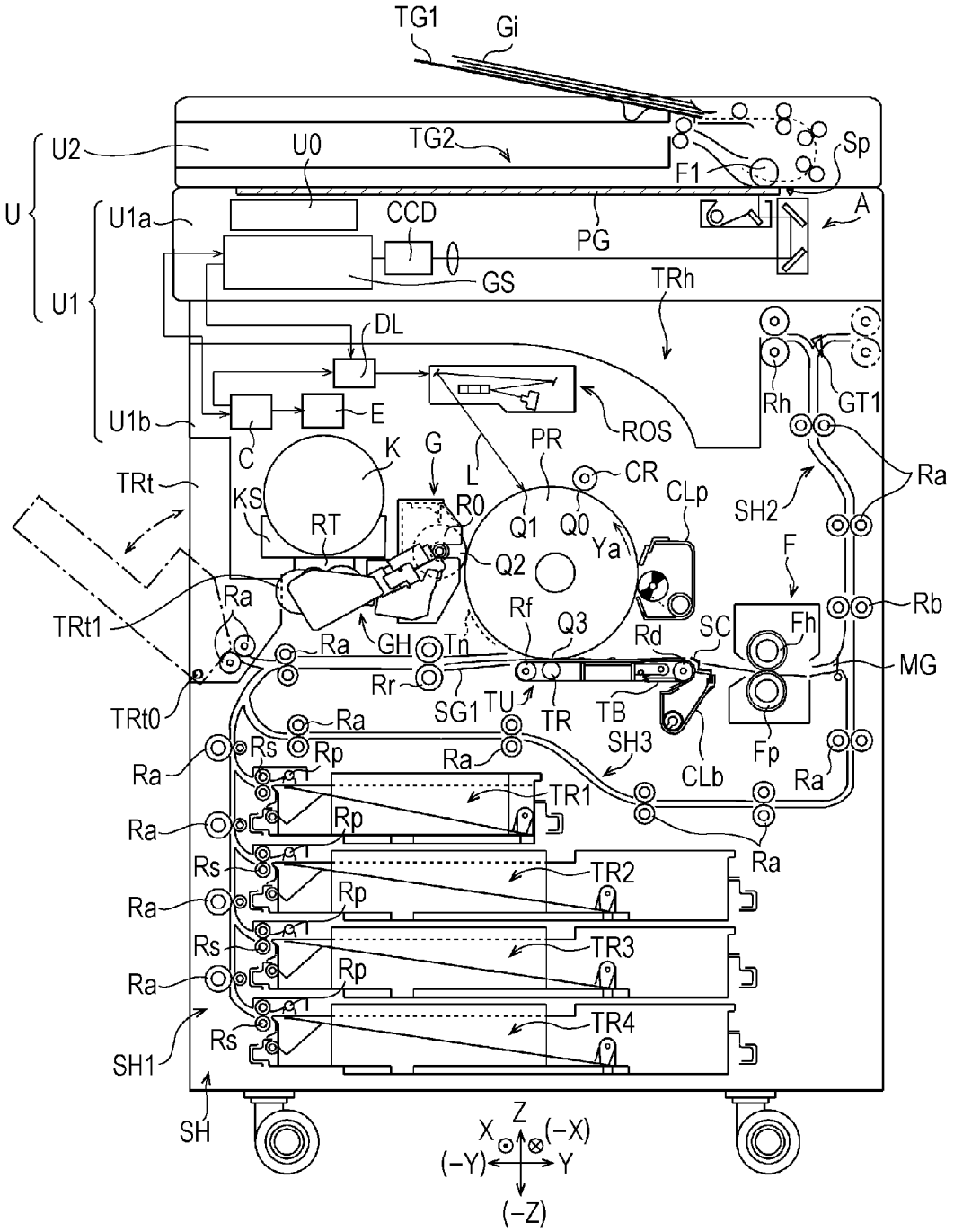
FIG. 1 illustrates an image forming apparatus including a developer transporting device according to an exemplary embodiment of the present invention.

FIG. 1 illustrates an image forming apparatus including a developer transporting device according to an exemplary embodiment of the present invention.

Referring to FIG. 1, a copy machine U is an example of the image forming apparatus according to the present exemplary embodiment. The copy machine U includes a copy machine body U1 as an example of a main body of the image forming apparatus. The copy machine body U1 includes a transparent platen glass PG, which is an example of an original document table, at the top surface thereof. An document transport device U2, which is an example of an additional device, is detachably supported on the platen glass PG.

The document transport device U2 includes an original document tray TG1 as an example of an original-document receiver. Sheets of original document Gi of which a copy is to be made are stacked on the original document tray TG1. The sheets of original document Gi placed on the original document tray TG1 are successively transported to a copy position on the platen glass PG, and are ejected to an original-document output tray TG2, which is an example of an original-document output unit.

The copy machine body U1 includes a scanner unit U1*a*, which is an example of an image reading unit, and a printer unit U1*b*, which is an example of an image recording unit. The scanner unit U1*a* includes an input unit U0 used by an operator who performs an input operation and the platen glass PG at the top surface thereof. In the present exemplary embodiment, the scanner unit U1*a* is provided with an image processor GS.

The scanner unit U1*a* includes an exposure registration sensor Sp and an exposure optical system A. The exposure registration sensor Sp is an example of a position detection member of an exposure system, and is arranged at an original-document reading position.

The exposure optical system A is moved or stopped under the control based on a detection signal from the exposure registration sensor Sp. In a steady state, the exposure optical system A is stopped at an initial position, that is, a home position, which is an example of an image reading position.

An automatic reading operation is performed to make a copy of the original document Gi by automatically transporting the sheets of original document Gi by using the document transport device U2. In this operation, the sheets of original document Gi that successively pass the copy position F1 on the platen glass PG are exposed to light from the exposure optical system A while the exposure optical system A is stopped at the home position.

A manual reading operation is performed when a user manually places each sheet of original document Gi on the platen glass PG to make a copy of the original document Gi. In this operation, each sheet of original document Gi placed on the platen glass PG is exposed to light from the exposure optical system A while the exposure optical system A is moving.

The light is reflected by the sheet of original document Gi, passes through the exposure optical system A, and is focused on a solid-state imaging device CCD, which is an example of an imaging element. The solid-state imaging device CCD converts the light reflected by the sheet of original document Gi and focused on an imaging surface of the solid-state imaging device CCD into an electrical signal.

The image processor GS receives a read image signal from the CCD in the scanner unit U1*a*, converts the received signal into a digital image write signal, and outputs the image write signal to an image write circuit DL included in the printer unit U1*b*.

The image write circuit DL receives the image write signal, generates a drive signal for forming a latent image that corresponds to the image write signal, and outputs the drive signal to an exposure device ROS, which is an example of a latent-image forming device.

A photoconductor drum PR, which is an example of an image carrier, is disposed below the exposure device ROS. The photoconductor drum PR rotates in the direction shown by arrow Ya. The surface of the photoconductor drum PR is charged by a charging roller CR, which is an example of a charging device, in a charging area Q0. Then, the surface of the photoconductor drum PR is exposed to and scanned with a laser beam L, which is an example of latent-image writing light emitted from the exposure device ROS, at a latent-image writing position Q1. Thus, a latent image is formed. The surface of the photoconductor drum PR on which the latent image is formed is moved as the photoconductor drum PR rotates, and successively passes through a developing area Q2 and a transfer area Q3.

A developing device G is opposed to the photoconductor drum PR in the developing area Q2. The developing device G includes a developing roller RO, which is an example of a developer carrier, for transporting the developer to the developing area Q2. The developing device G forms a toner image, which is an example of a visible image, by developing the electrostatic latent image that passes through the developing area Q2.

A cartridge K, which is an example of a developer container for supplying the developer to be consumed by the developing device G, is disposed on the left side of the developing device G. The cartridge K is detachably attached to a cartridge holder KS, which is an example of a container holder. The developer contained in the cartridge K is transported while being stirred in a reservoir tank RT, which is an example of a temporal reservoir, and is supplied to the developing device G by a transporting system GH that is connected to the reservoir tank RT.

Paper feed trays TR1 to TR4, which are examples of medium storage units, are detachably supported in an area below the copy machine body U1. Recording sheets S, which are examples of media, are stored in the paper feed trays TR1 to TR4.

The sheets S on the trays TR1 to TR4 are fed by pick-up rollers Rp, which are examples of pick-up members, at a predetermined paper-feed time, and are separated from each other by separation rollers Rs, which are examples of separation members. Then, each sheet S is transported by plural transport rollers Ra, which are examples of medium transport members, to registration rollers Rr, which are examples of feeding members.

A manual feed tray TRt, which is an example of a manual feed unit, is disposed on the left side of the cartridge holder KS and the reservoir tank RT. Sheets S fed from the manual feed tray TRt are also transported to the registration rollers Rr. The manual feed tray TRt according to the present exemplary embodiment is supported such that the manual feed tray TRt is rotatable around a rotational center TRt0. When the manual feed tray TRt is placed in the image forming apparatus U, as shown by the solid lines in FIG. 1, a part TRt1 of the manual feed tray TRt that is near the rotational center TRt0 thereof is located in a space below the cartridge holder KS and on the left side of the reservoir tank RT. Thus, the manual feed tray TRt is space-efficiently arranged manner and the overall size of the copy machine U is reduced.

Each sheet S that has been transported to the registration rollers Rr is transported from a pre-transfer sheet guide SG1, which is an example of a pre-transfer guiding member, to the transfer area Q3 in synchronization with the time at which the toner image on the surface of the photoconductor drum PR is moved to the transfer area Q3.

A transfer unit TU, which is an example of a transfer device or a transfer-transport device, is opposed to the photoconductor drum PR in the transfer area Q3. The transfer unit TU includes a transfer-transport belt TB, which is an example of a medium transporting member. The transfer-transport belt TB supports the recording sheet S that has been transported to the transfer area Q3 on the surface thereof, and transports the recording sheet S. The transfer-transport belt TB is rotatably supported by belt support rollers Rd+Rf, which are examples of medium-transporting-member support units. The belt support rollers include Rd+Rf a driving roller Rd, which is an example of a driving member, and a driven roller Rf, which is an example of a driven member. A transfer roller TR, which is an example of a transfer member, is opposed to the photoconductor drum PR with the transfer-transport belt TB disposed therebetween.

A transfer voltage is applied to the transfer roller TR by a power supply circuit E controlled by a controller C, which is an example of a control unit. Accordingly, a toner image Tn on the surface of the photoconductor drum PR is transferred onto the recording sheet S that passes through the transfer area Q3.

After the transfer process, residual toner that remains on the surface of the photoconductor drum PR is removed by a photoconductor cleaner CLp, which is an example of an image-carrier cleaner. Then, the surface of the photoconductor drum PR is charged again by the charging roller CR.

A separating claw SC, which is an example of a medium-separating member, is opposed to the driving roller Rd with the transfer-transport belt TB interposed therebetween. The sheet S onto which the toner image has been transferred by the transfer roller TR in the transfer area Q3 is separated from the surface of the transfer-transport belt TB by the separating claw SC at a position downstream of the transfer area Q3.

A belt cleaner CLb, which is an example of a medium-transporting-member cleaner, is disposed downstream of the separating claw SC in the rotational direction of the transfer-transport belt TB. The belt cleaner CLb removes the developer, paper dust, etc., from the surface of the transfer-transport belt TB after the recording sheet S is separated therefrom.

The separated sheet S is transported to a fixing device F which includes a heating roller Fh, which is an example of a heat-fixing member, and a pressing roller Fp, which is an example of a pressure-fixing member. The fixing device F fixes the toner image to the sheet S by applying heat and pressure. The sheet S to which the toner image has been fixed passes through a first gate MG, which is an example of a switch member made of an elastic material, while elastically deforming the first gate MG. Then, the recording sheet S is transported to transport rollers Rb, which are rotatable in both normal and reverse directions, on a sheet ejection path SH2, which is an example of a medium ejection path.

The sheet S is transported along the sheet ejection path SH2 on which the transport rollers Rb that are rotatable in both normal and reverse directions and plural transport rollers Ra are arranged, and is ejected to a paper output tray TRh. A second gate GT1, which is an example of a switch member, is disposed at the downstream end of the sheet ejection path SH2. In the case where a post-processing device (not shown) is connected to the copy machine U, the second gate GT1 selectively ejects the sheet S to either the paper output tray TRh, which is an example of a medium output unit, or the post-processing device (not shown). In the case where no post-processing device is connected, the second gate GT1 ejects the sheet S that has been transported to the downstream end of the sheet ejection path SH2 to the paper output tray TRh.

In the case where duplex printing is performed, when the sheet S having an image formed on one side thereof is transported to the transport rollers Rb that are rotatable in both normal and reverse directions, the transport rollers Rb start to rotate in the reverse direction before the trailing edge of the recording sheet S passes the transport rollers Rb. Accordingly, the sheet S is transported backward in a so-called switchback manner in the sheet ejection path SH2. The first gate MG guides the sheet S that has been transported backward by the transport rollers Rb in the switchback manner toward a circulation transport path SH3, which is an example of a circulation path. The sheet S that has been transported to the circulation transport path SH3 is transported to the transfer area Q3 again in a reversed manner. Thus, the sheet S having an image formed on a first side thereof is transported to the transfer area Q3 again, and a toner image is transferred onto a second side of the recording sheet S.

A medium transporting device SH according to the present exemplary embodiment includes the above-described components denoted by SH1 to SH3, Rp, Rs, Rr, Ra, Rb, and MG.

Description of Developer Transporting Device

Figure 2:
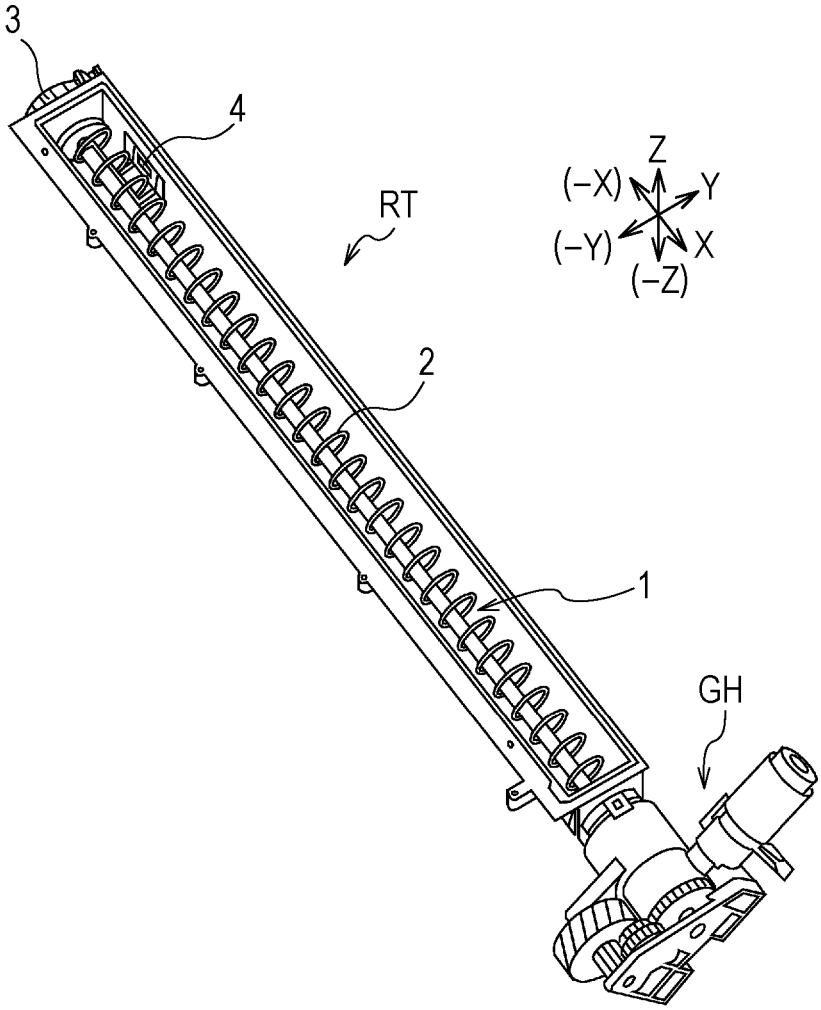
FIG. 2 illustrates a reservoir tank according to the exemplary embodiment.

FIG. 2 illustrates the reservoir tank RT according to the present exemplary embodiment.

Referring to FIG. 2, the reservoir tank RT according to the present exemplary embodiment includes a tank body 1 as an example of a transporting unit. The tank body 1 extends in the front-back direction and contains the developer therein. A supplying auger 2, which is an example of a transporting member, is rotatably supported in the tank body 1 such that the supplying auger 2 extends in the front-back direction. A supply gear 3, which is an example of a rotation-transmitting member, is supported at the back end of the supplying auger 2. Rotation of a drive source (not shown) is transmitted to the supply gear 3. Accordingly, the developer in the tank body 1 is transported in the direction from back to front. An empty-state detection sensor 4, which is an example of a detection member, is provided on a side wall of the tank body 1 at the back end thereof. The empty-state detection sensor 4 determines whether or not the cartridge K is empty by detecting the developer that flows into the tank body 1.

The transporting system GH is provided at the front end of the tank body 1. The transporting system GH transports the developer that has been transported to the front end of the tank body 1 by the supplying auger 2 to the developing device G. The transporting system GH is commonly known, and a system described in Japanese Unexamined Patent Application Publication No. 2008-129357, for example, may be used. Various types of transporting systems may be used as the transporting system GH, and detailed explanations thereof are thus omitted.

Figure 3:
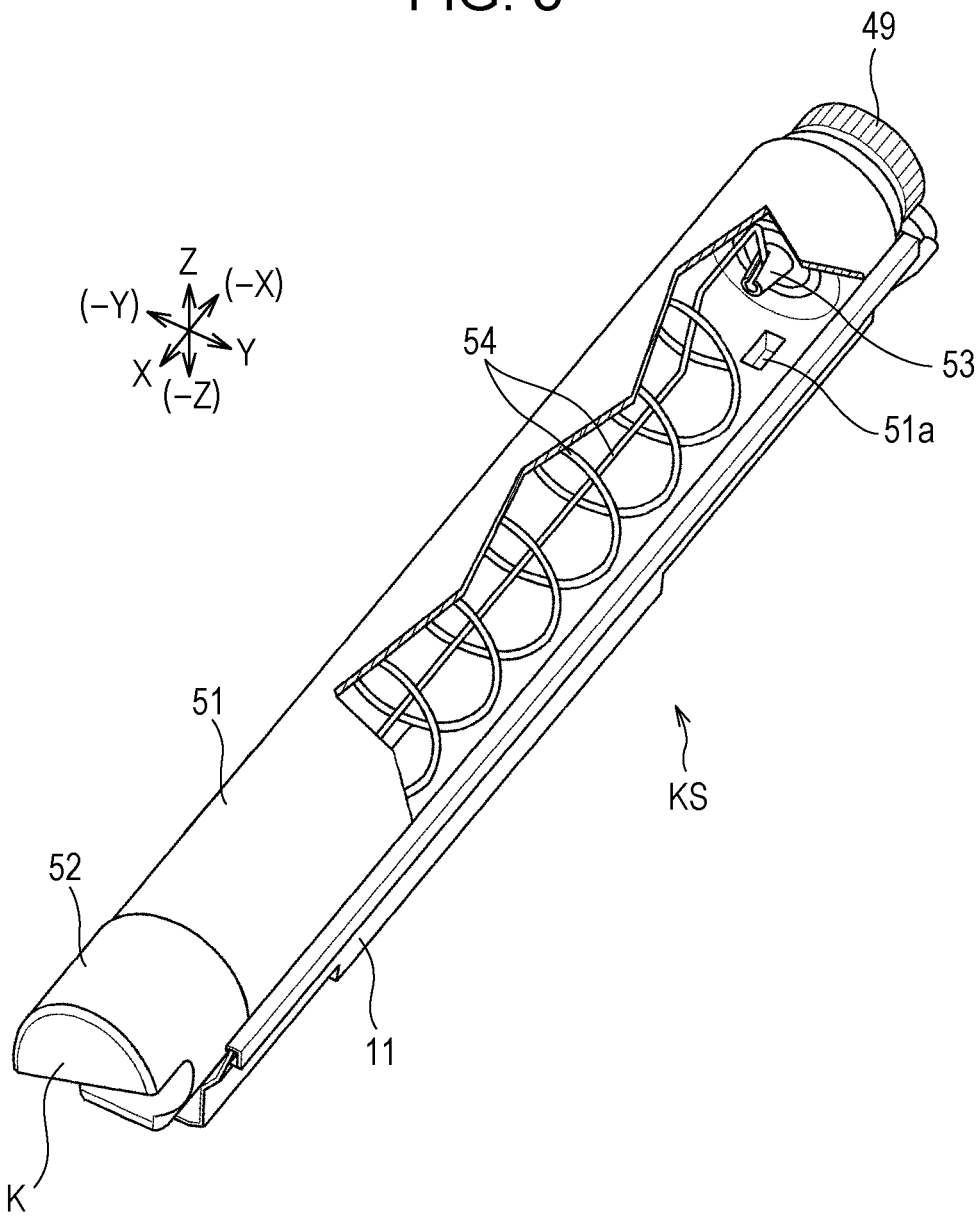
FIG. 3 is a perspective view illustrating the state in which a toner cartridge is attached to a cartridge holder according to the exemplary embodiment.

FIG. 3 is a perspective view illustrating the state in which the toner cartridge K is attached to the cartridge holder KS according to the present exemplary embodiment.

Figure 4A:
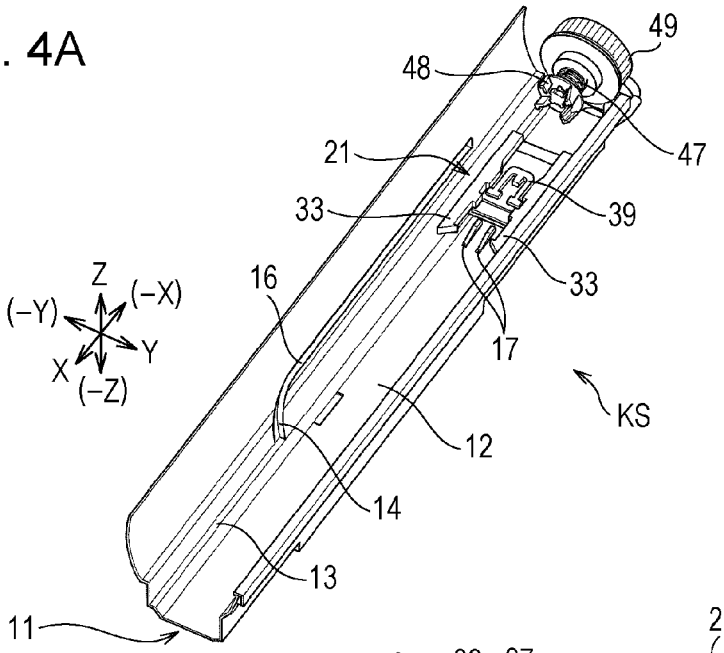
FIG. 4A illustrates the state in which the toner cartridge illustrated in FIG. 3 is removed from the cartridge holder.
Figure 4B:
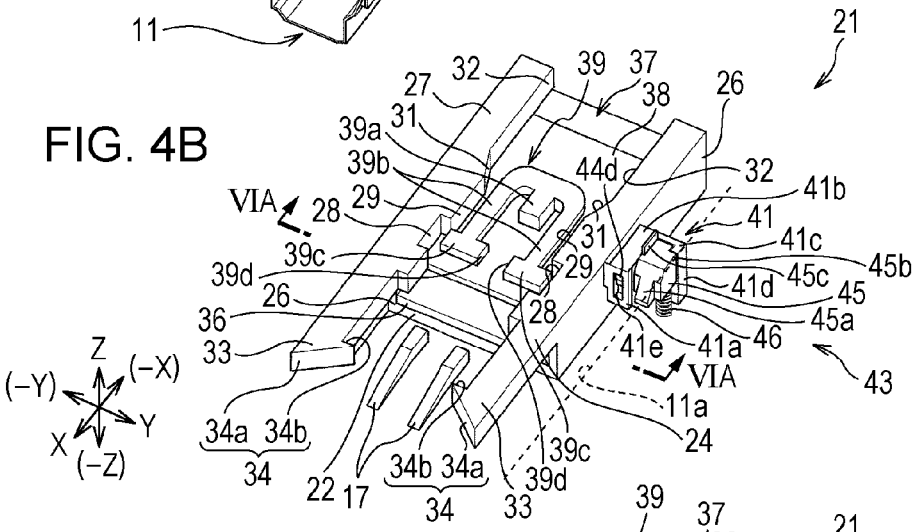
FIG. 4B illustrates a part of the cartridge holder in the state in which a main-body shutter is at a closed position.
Figure 4C:
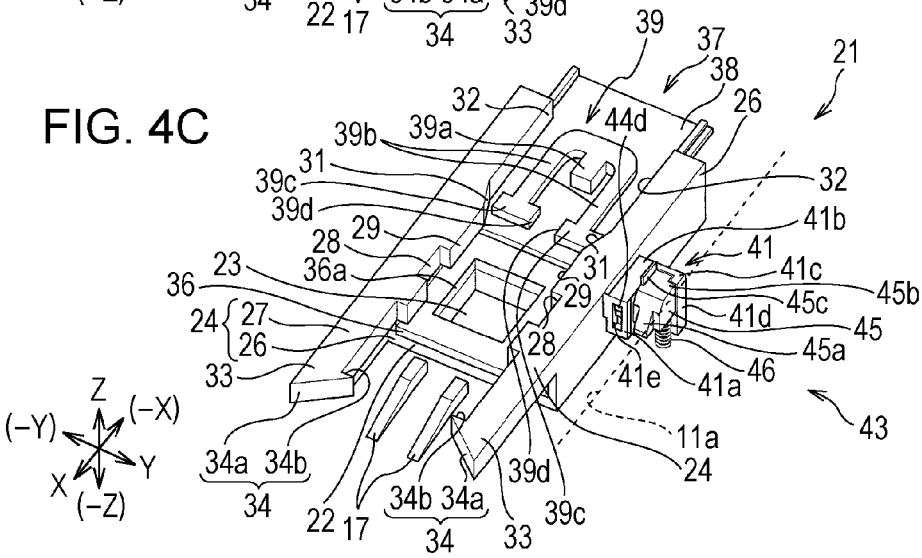
FIG. 4C illustrates the part of the cartridge holder in the state in which the main-body shutter is at an open position.

FIG. 4A illustrates the state in which the toner cartridge K illustrated in FIG. 3 is removed from the cartridge holder KS. FIG. 4B illustrates a part of the cartridge holder KS in the state in which a main-body shutter 37 is at a closed position. FIG. 4C illustrates the part of the cartridge holder KS in the state in which the main-body shutter 37 is at an open position.

Referring to FIGS. 1, 3, and 4A, the cartridge holder KS is supported above the reservoir tank RT, and includes a holder body 11, which is an example of the main body of a container support member. The holder body 11 extends in the front-back direction. The holder body 11 has a substantially cylindrical inner peripheral surface, and a cartridge shutter passage 12, which is an example of an outlet cover member passage, is formed at the bottom of the holder body 11. The cartridge shutter passage 12 is recessed downward and extends in the front-back direction.

Referring to FIG. 4A, a step-shaped projection passage 13, which is an example of a contact-body passage, is formed in the upper left area of the cartridge shutter passage 12. A first projection guide groove 14, which is an example of a first guide portion for an opening-closing-member contact portion, is provided behind the projection passage 13. The first projection guide groove 14 is formed as a helical recessed portion that extends from a central position of the holder body 11 in the front-back direction toward the upper left and back along the inner peripheral surface of the holder body 11. A second projection guide groove 16, which is an example of a second guide portion for the opening-closing-member contact portion, is formed so as to extend continuously from the top end of the first projection guide groove 14. The second projection guide groove 16 is formed as a recessed portion that extends backward.

The projection passage 13, the first projection guide groove 14, and the second projection guide groove 16 serve as the members 13 to 16 for moving the outlet cover member according to the present exemplary embodiment.

Referring to FIGS. 4A to 4C, plural rattling preventing ribs 17, which are examples of rattling preventing portions, are formed in a back area of the cartridge shutter passage 12. The rattling preventing ribs 17 are inclined upward toward the back.

Description of Inlet Shutter Holder

A main-body-shutter holder 21, which is an example of a support member for an inlet cover member, is provided behind the rattling preventing ribs 17. The main-body-shutter holder 21 includes a bottom portion 22 at the bottom end thereof, and an inlet 23 is formed at a central area of the bottom portion 22. The inlet 23 extends through the holder body 11 in the up-down direction. Referring to FIG. 2, the inlet 23 opens into the reservoir tank RT at a position above the position where the empty-state detection sensor 4 is disposed at the back end of the reservoir tank RT.

Main-body shutter guides 24, which are examples guide portions for guiding an inlet cover member, are formed integrally with the main-body-shutter holder 21 at the left and right sides thereof. The main-body shutter guides 24 extend in the front-back direction. According to the present exemplary embodiment, the main-body shutter guides 24 include left and right vertical wall portions 26 that extend upward from the left and right sides of the bottom portion 22, and top wall portions 27 that extend inward from the top ends of the vertical wall portions 26.

Recesses 28, which are examples of deformation-allowing portions, are formed in inner side surfaces of the top wall portions 27 in the left-right direction at the front end thereof. The recesses 28 are recessed outward in the left-right direction. Narrowing portions 29, inclined portions 31, and broadening portions 32 are formed on the inner side surfaces of the top wall portions 27 in the area behind the recesses 28. The narrowing portions 29 are examples of deformation-restraining portions, and extend backward. The inclined portions 31 are examples of guide portions, and extend from the back ends of the narrowing portions 29 such that the inclined portions 31 are inclined outward in the left-right direction toward the back. The broadening portions 32 are also examples of deformation-allowing portions, and extend from the back ends of the inclined portions 31 so as to extend backward.

Left and right locking arms 33, which are examples of restraining-member bodies for restraining an outlet cover member, are formed integrally with the main-body-shutter holder 21 so as to extend forward from the top wall portions 27. Locking claws 34, which are examples of contact portions, are formed so as to project inward in the left-right direction at the front ends of the locking arms 33. The locking claws 34 include front guide surfaces 34*a*, which are examples of guide portions used in an attaching process, and back end faces 34*b*. The front guide surfaces 34*a* are front end faces that are inclined inward in the left-right direction toward the back. The back end faces 34*b* extend in the left-right direction from the inner ends of the front guide surfaces 34*a*.

Referring to FIGS. 4A to 4C, a plate-shaped main-body sealing member 36, which is an example of a leakage preventing member, is supported on the top surface of the bottom portion 22. In the present exemplary embodiment, the main-body sealing member 36 is composed of a sponge, which is an example of an elastic material. An opening 36*a* that corresponds to the inlet 23 is formed in the main-body sealing member 36.

Description of Main-Body Shutter

Figure 5A:
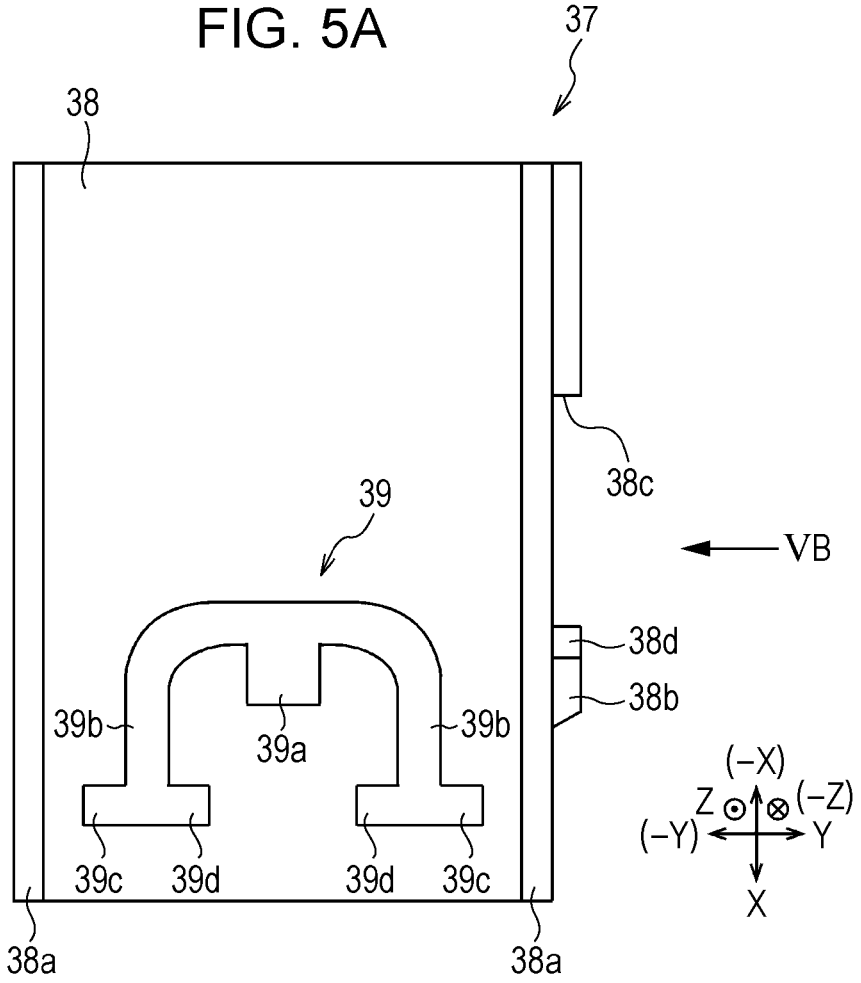
FIG. 5A is a plan view of the main-body shutter according to the exemplary embodiment.
Figure 5B:
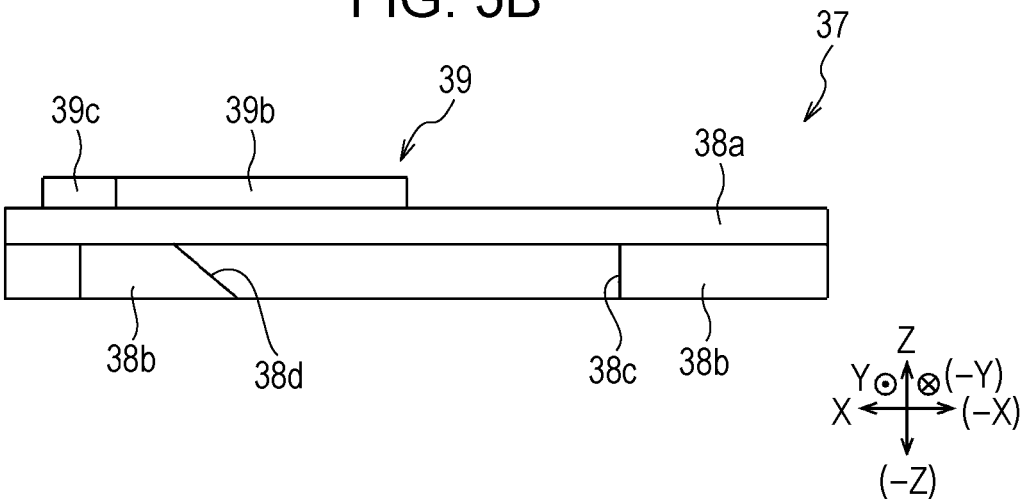
FIG. 5B illustrates the main-body shutter viewed in the direction of arrow VB in FIG. 5A.

FIG. 5A is a plan view of the main-body shutter 37 according to the present exemplary embodiment. FIG. 5B illustrates the main-body shutter 37 viewed in the direction of arrow VB in FIG. 5A.

Referring to FIGS. 4A to 4C, the main-body shutter 37, which is an example of an inlet cover member, is supported on the top surface of the main-body sealing member 36. Referring to FIGS. 4A to 4C, 5A, and 5B, in the present exemplary embodiment, the main-body shutter 37 includes a plate-shaped shutter body 38, which is an example of an inlet-cover-member body. The bottom surface of the shutter body 38 comes into contact with the main-body sealing member 36, so that the risk of leakage of the developer is reduced.

Referring to FIGS. 5A and 5B, ribs 38*a* to be guided, which are examples of guided portions, are formed at the left and right sides of the shutter body 38 so as to extend in the front-back direction and project upward. The ribs 38*a* are supported by the main-body shutter guides 24 such that the ribs 38*a* are movable in the front-back direction. Thus, the shutter body 38 may be moved forward to the closed position illustrated in FIG. 4B at which the inlet 23 is closed, or backward to the open position illustrated in FIG. 4C at which the inlet 23 is open.

In FIGS. 5A and 5B, a protruding portion 38*b* that protrudes rightward is formed on the right side of the shutter body 38. The protruding portion 38*b* has a cut portion 38*c* at an intermediate position of the protruding portion 38*b* in the front-back direction. The cut portion 38*c* is an example of a portion to be stopped, and is recessed toward the left side. The cut portion 38*c* has a main-body inclined surface 38*d*, which is an example of a first inclined surface, at the front end thereof. The main-body inclined surface 38*d* is inclined downward toward the back side, that is, toward the position for opening the inlet 23.

Referring to FIGS. 4A to 4C, 5A, and 5B, a main-body contact portion 39, which is an example of a main-body engagement member, is supported on the top surface of the shutter body 38. The main-body contact portion 39 is substantially U-shaped as a whole, and is connected to the shutter body 38 at a back end portion 39*a* thereof that is positioned at a central position in the left-right direction. The main-body contact portion 39 includes left and right arms 39*b*, which are examples of deforming portions. The arms 39*b* extend forward from the back end portion 39*a* and are elastically deformable. Outer claw portions 39*c*, which are examples of contact portions that come into contact with the deformation-restraining portions, and inner claw portions 39*d*, which are examples of engaging retainers, are provided at the front ends of the arms 39*b*. The outer claw portions 39*c* project outward in the left-right direction and the inner claw portions 39*d* project inward in the left-right direction. In the present exemplary embodiment, the distance between the outer ends of the outer claw portions 39*c* is set in accordance with the distance between the broadening portions 32, more specifically, to a distance smaller than the distance between the recesses 28 and larger than the distance between the narrowing portions 29.

Description of Main-Body-Shutter Lock

Figure 6A:
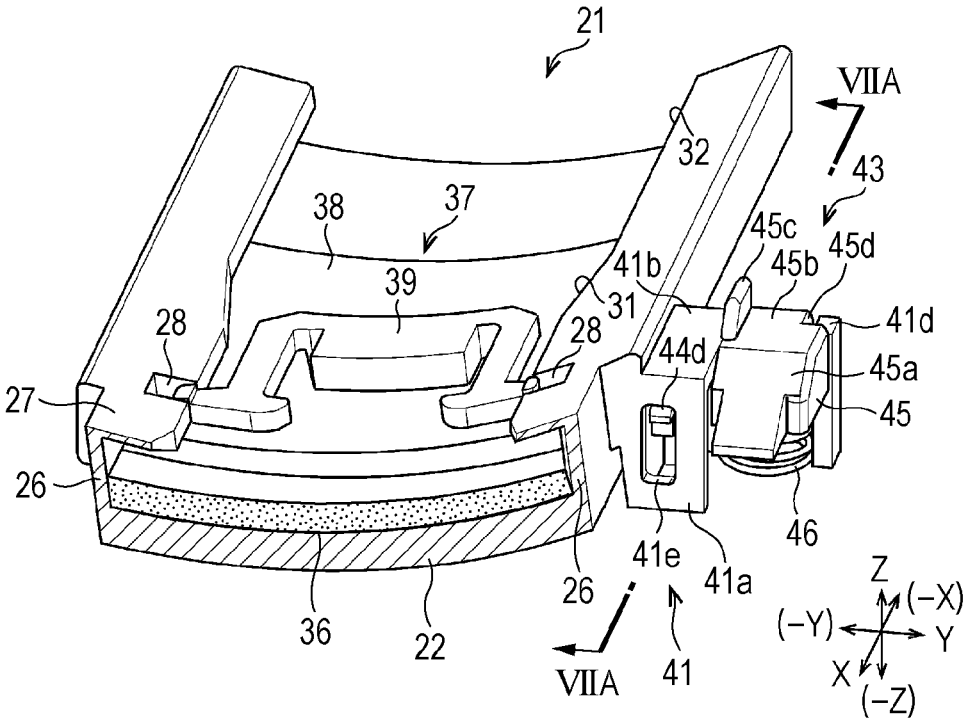
FIG. 6A is a sectional view illustrating a main-body-shutter lock according to the exemplary embodiment taken along line VIA-VIA in FIG. 4B.
Figure 6B:
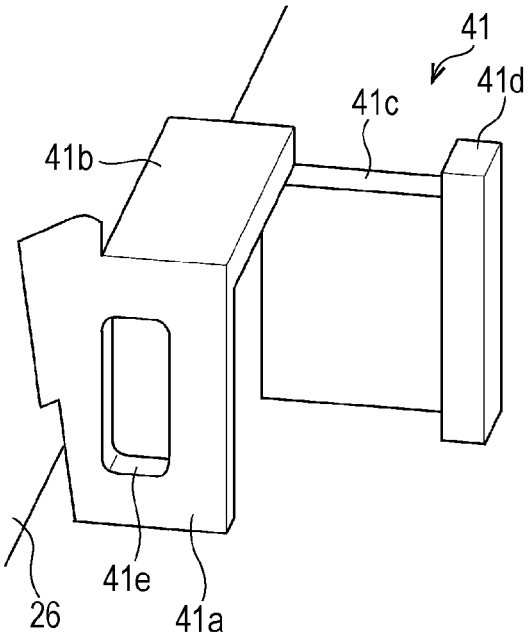
FIG. 6B is an enlarged view of a lock support portion.

FIG. 6A is a sectional view illustrating a main-body-shutter lock 43 according to the present exemplary embodiment taken along line VIA-VIA in FIG. 4B. FIG. 6B is an enlarged view of a lock support portion 41.

Referring to FIGS. 4A to 4C, 6A, and 6B, the lock support portion 41, which is an example of a stopper-member support portion, is supported on the right vertical wall portion 26 of the main-body-shutter holder 21 so as to project rightward. The lock support portion 41 includes a plate-shaped front plate 41*a* that is disposed at the front end so as to extend in the up-down direction; a plate-shaped left plate 41*b* that extends backward from the top end of the front plate 41*a*; a plate-shaped back plate 41*c* that extends rightward from the back end of the left plate 41*b*; and a right column 41*d* that extends in the up-down direction at the right end of the back plate 41*c*.

A guide hole 41*e*, which is an example of a guide portion, is formed in the front plate 41*a*. The guide hole 41*e* is a rectangular opening that extends in the up-down direction.

Figure 7A:
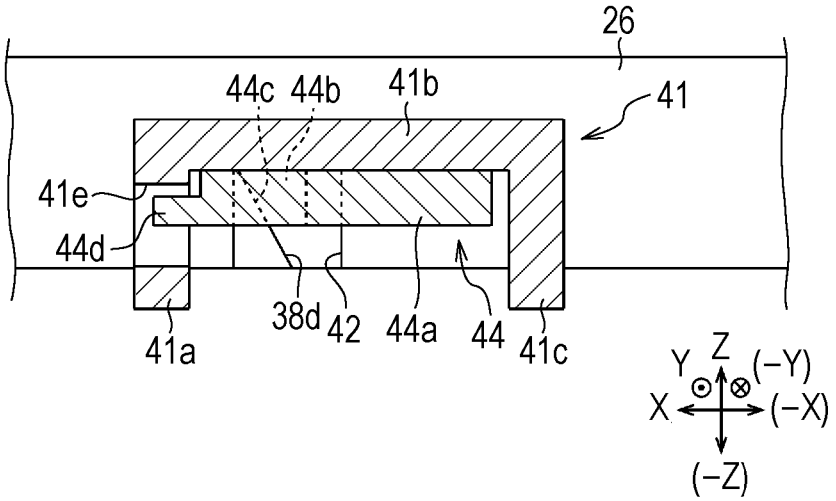
FIG. 7A is a sectional view the lock support portion according to the exemplary embodiment taken along line VIIA-VIIA in FIG. 6A.
Figure 7B:
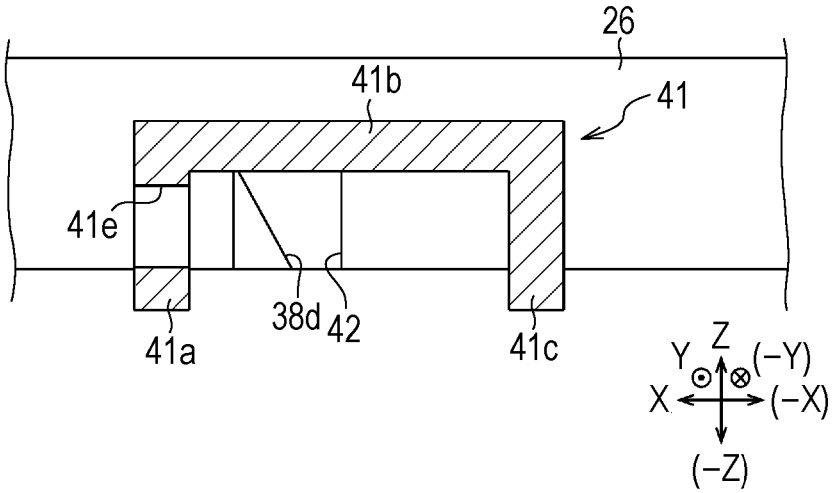
FIG. 7B illustrates the state in which the main-body-shutter lock is removed from the structure illustrated in FIG. 7A.

FIG. 7A is a sectional view of the lock support portion 41 according to the present exemplary embodiment taken along line VIIA-VIIA in FIG. 6A. FIG. 7B illustrates the state in which the main-body-shutter lock 43 is removed from the structure illustrated in FIG. 7A.

Referring to FIG. 7B, a lock passage hole 42, which is an example of a stopper-member passage, is formed in the inner vertical wall portion 26 and an area surrounded by the lock support portion 41 at a position corresponding to the main-body inclined surface 38*d* of the cut portion 38*c* in the shutter body 38 when the shutter body 38 is at the position for closing the inlet 23. The lock passage hole 42 extends through the vertical wall portion 26 in the left-right direction, and also extends downward through the bottom portion 22.

Figure 8A:
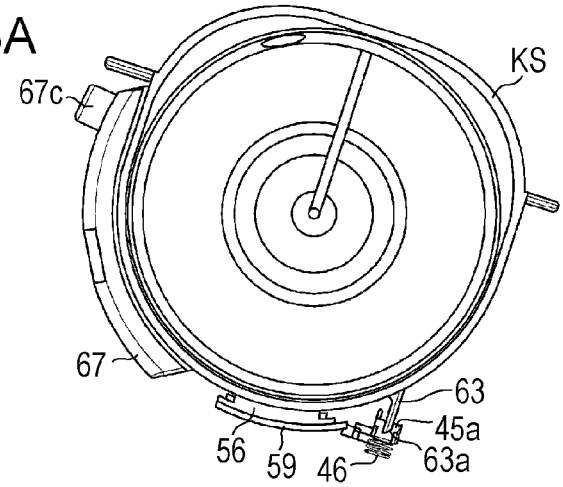
FIG. 8A is a front view illustrating the state in which the main-body-shutter lock according to the present exemplary embodiment is at a stopping position.
Figure 8B:
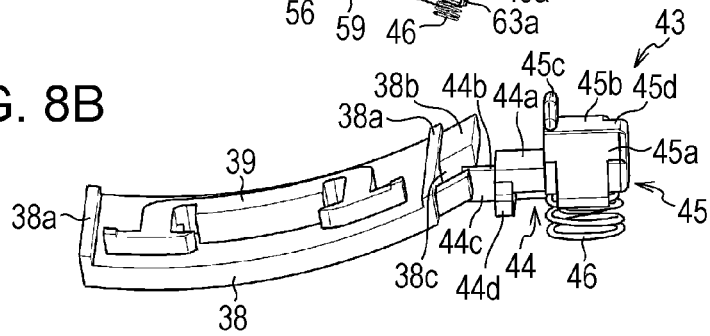
FIG. 8B illustrates the positional relationship between the main-body shutter and the main-body-shutter lock in the state in which the main-body-shutter lock is at the stopping position.
Figure 8C:
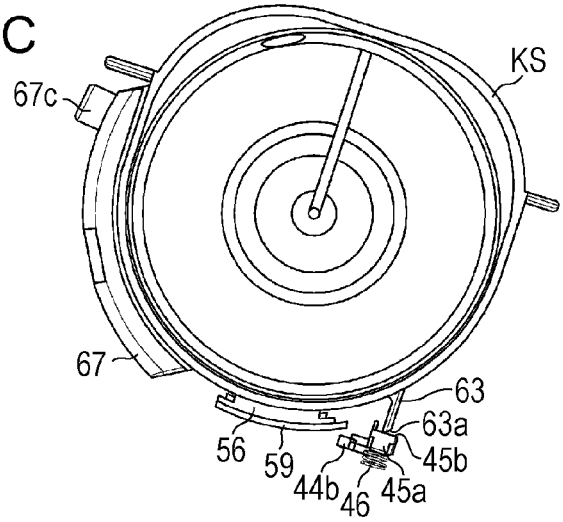
FIG. 8C is a front view illustrating the state in which the main-body-shutter lock is at a releasing position.
Figure 8D:
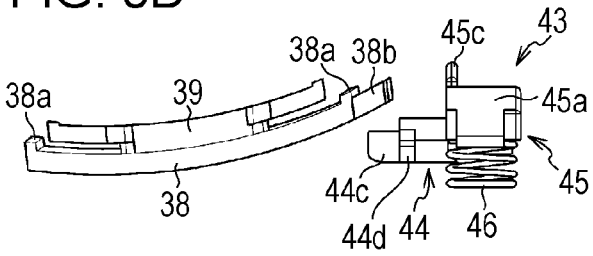
FIG. 8D illustrates the positional relationship between the main-body shutter and the main-body-shutter lock in the state in which the main-body-shutter lock is at the releasing position.
Figure 8E:
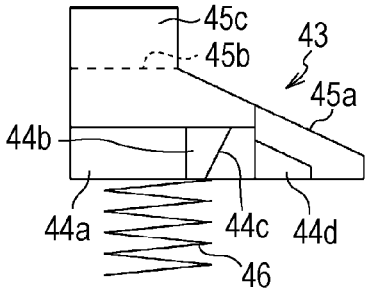
FIG. 8E is a left side view of the main-body-shutter lock.

FIG. 8A is a front view illustrating the state in which the main-body-shutter lock 43 according to the present exemplary embodiment is at a stopping position. FIG. 8B illustrates the positional relationship between the main-body shutter and the main-body-shutter lock 43 in the state in which the main-body-shutter lock 43 is at the stopping position. FIG. 8C is a front view illustrating the state in which the main-body-shutter lock 43 is at a releasing position. FIG. 8D illustrates the positional relationship between the main-body shutter and the main-body-shutter lock 43 in the state in which the main-body-shutter lock 43 is at the releasing position. FIG. 8E is a left side view of the main-body-shutter lock 43.

Referring to FIGS. 4A to 4C, 6A and 6B, and 8A to 8E, the main-body-shutter lock 43, which is an example of a restraining member, is supported by the lock support portion 41 such that the main-body-shutter lock 43 is movable in the up-down direction. As illustrated in FIGS. 8A to 8E, the main-body-shutter lock 43 includes a left lock body 44, which is an example of a stopper-member body, and a releasing block 45, which is an example of a releasing contact portion. The left lock body 44 is arranged so as to be surrounded by the lock support portion 41. The releasing block 45 is supported on the right side of the left lock body 44.

The lock body 44 includes a plate-shaped base portion 44*a*. A projection 44*b*, which is an example of a contact portion, is formed at the left end of the base portion 44*a*. The projection 44*b* extends leftward through the lock passage hole 42. Referring to FIGS. 7A and 8E, the projection 44*b* has a lock inclined surface 44*c*, which is an example of a second inclined surface, at the front end thereof. The lock inclined surface 44*c* is inclined downward toward the back side, and is capable of facing and coming into contact with the main-body inclined surface 38*d*. In FIGS. 6A, 6B, and 8A to 8E, a protrusion-shaped guided member 44*d*, which is an example of a guided portion, is formed at the front end of the base portion 44*a* so as to project forward. The guided member 44*d* may be guided along the guide hole 41*e* in the up-down direction while being fitted in the guide hole 41*e*.

The releasing block 45 has a guide surface 45*a*, which is an example of a releasing contact portion. The guide surface 45*a* is inclined upward from the front end toward the back side, and a flat contact surface 45*b*, which is an example of a releasing retainer portion, is formed at the top end of the guide surface 45*a* so as to extend backward.

A movement-stabilizing rib 45*c*, which is an example of a protrusion and which is also an example of a movement stabilizing portion, is formed at the left end of the contact surface 45*b*. The movement-stabilizing rib 45*c* is disposed adjacent to the left plate 41*b*, which is an example of an adjacent member, and extends upward. A guide recess 45*d* is formed at the back right side of the releasing block 45. The guide recess 45*d* has a shape corresponding to the shape of the right column 41*d*, and is guided by the right column 41*d*.

A lock spring 46, which is an example of an urging member, is disposed between the bottom surface of the releasing block 45 and the top surface of the cartridge shutter passage 12. The lock spring 46 urges the main-body-shutter lock 43 upward.

The main-body-shutter lock 43 according to the present exemplary embodiment is supported such that the main-body-shutter lock 43 is movable between the upper position illustrated in FIGS. 8A and 8B, which is a stopping position, and the lower position illustrated in FIGS. 8C and 8D, which is a releasing position.

At the stopping position illustrated in FIGS. 8A and 8B, the lock projection 44*b* faces the main-body inclined surface 38*d*. Therefore, even when the main-body shutter 37 tries to move backward toward the position for opening the inlet 23, the lock projection 44*b* comes into contact with the main-body inclined surface 38*d* and restrains the main-body shutter 37 from moving. Thus, at the stopping position illustrated in FIGS. 8A and 8B, the main-body shutter 37 is restrained from moving to the position for opening the inlet 23 by the lock projection 44*b*, that is, the main-body shutter 37 is set to a locked state.

At the releasing position illustrated in FIGS. 8C and 8D, the lock projection 44*b* is moved downward and does not face the main-body inclined surface 38*d*. Therefore, the main-body shutter 37 is movable to the position for opening the inlet 23. In other words, the main-body shutter 37 is released from the locked state.

At the releasing position illustrated in FIGS. 8C and 8D, the top end of the movement-stabilizing rib 45*c* of the main-body-shutter lock 43 projects upward from the left plate 41*b*. Therefore, even when the main-body-shutter lock 43 pushed by the lock spring 46 tries to tilt leftward, the movement-stabilizing rib 45*c* comes into contact with the left plate 41*b* that is adjacent thereto. Thus, the main-body-shutter lock 43 is prevented from tilting, and the posture of the main-body-shutter lock 43 is regulated. As a result, according to the present exemplary embodiment, the possibility that the main-body-shutter lock 43 will tilt leftward at the releasing position and will not be able to return to the stopping position is reduced. Thus, the posture of the main-body-shutter lock 43 is stabilized and the main-body-shutter lock 43 may be stably moved upward and downward.

The main-body-shutter lock 43 is supported such that the main-body-shutter lock 43 is movable between the stopping position and the releasing position in the up-down direction while the guided member 44*d*, the movement-stabilizing rib 45*c*, and the guide recess 45*d* are guided by the guide hole 41*e*, the left plate 41*b*, and the right column 41*d*, respectively.

The components denoted by reference numerals 41 to 46 form a main-body lock mechanism 41 to 46 as an example of a restraining member according to the present exemplary embodiment.

Referring to FIGS. 3 and 4A, a rotational shaft 47 is rotatably supported on the back end wall (not shown) at the back end of the holder body 11. A coupling 48, which is an example of a rotation-transmitting member, is supported at the front end of the rotational shaft 47. A cartridge driving gear 49, which is also an example of a rotation-transmitting member, is supported at the back end of the rotational shaft 47. The cartridge driving gear 49 is configured such that rotation of a drive source (not shown) may be transmitted thereto.

The cartridge holder KS according to the present exemplary embodiment includes the components denoted by reference numerals 11 to 49. The components denoted by reference numerals 11 to 49, in other words, the reservoir tank RT and the cartridge holder KS, form a transporting device body RT+KS according to the present exemplary embodiment.

Description of Cartridge

Referring to FIG. 3, the cartridge K, which is an example of a container according to the present exemplary embodiment, includes a cylindrical cartridge body 51, which is an example of a developer containing portion. The cartridge body 51 extends in the front-back direction and contains therein the developer to be supplied. An outlet 51*a*, which is an example of a connection hole, is formed in the cartridge body 51 at the back end thereof. The developer in the cartridge body 51 flows out of the cartridge body 51 through the outlet 51*a*.

A handle 52, which is an example of a handle portion, to be grabbed by a user is provided at the front end of the cartridge body 51.

A coupling 53, which is also an example of a rotation-transmitting member, is rotatably provided in the cartridge body 51 at the back end thereof. The coupling 53 meshes with the coupling 48 so that rotation is transmitted to the coupling 53. The back end of an agitator 54, which is an example of a developer transporting member, is connected to the coupling 53. In the present exemplary embodiment, the agitator 54 is formed in the shape of a coil spring, that is, in the shape obtained by helically winding a wire. When the coupling 53 is rotated, the agitator 54 transports the developer in the cartridge K toward the outlet 51*a*.

Description of Inner Shutter and Guides Thereof

Figure 9A:
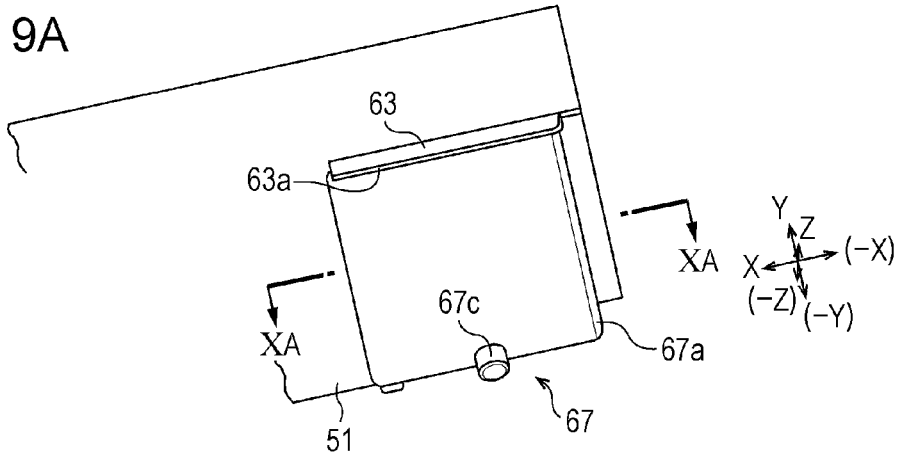
FIG. 9A illustrates a shutter unit on the cartridge according to the exemplary embodiment in the state in which an outer shutter is at a position for closing an outer side.
Figure 9B:
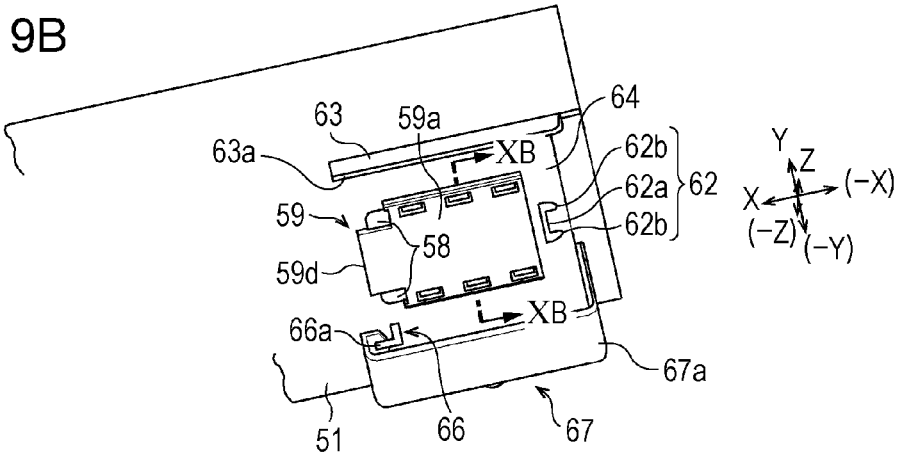
FIG. 9B illustrates the shutter unit in the state in which the outer shutter is at a position for opening the outer side and an inner shutter is at a position for closing an outlet.
Figure 9C:
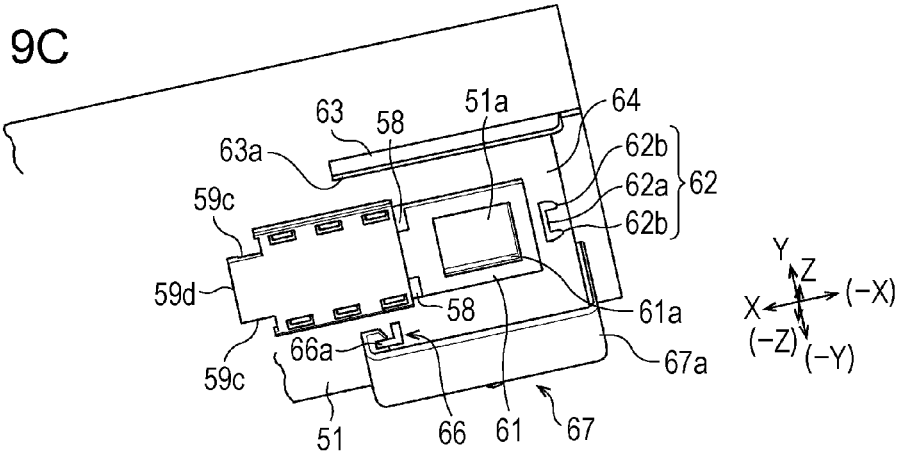
FIG. 9C illustrates the shutter unit in the state in which the outer shutter and the inner shutter are at the respective opening positions.

FIG. 9A illustrates a shutter unit on the cartridge K according to the present exemplary embodiment in the state in which an outer shutter 67 is at a position for closing an outer side. FIG. 9B illustrates the shutter unit in the state in which the outer shutter 67 is at a position for opening the outer side and an inner shutter 59 is at a position for closing the outlet 51*a*. FIG. 9C illustrates the shutter unit in the state in which the outer shutter 67 and the inner shutter 59 are at the respective opening positions.

Figure 10A:
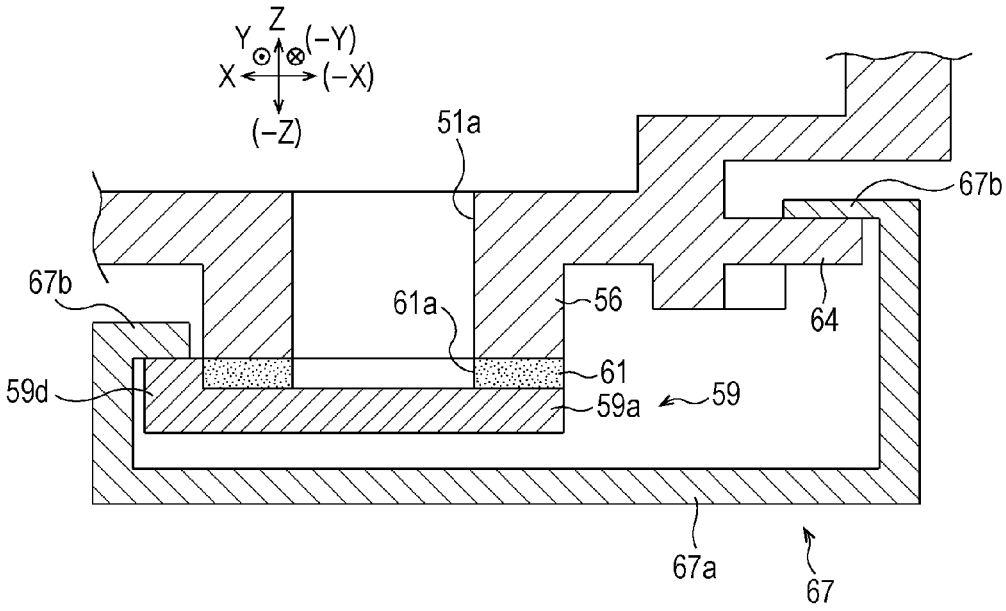
FIG. 10A is a sectional view of an inner-shutter support according to the exemplary embodiment taken along line XA-XA in FIG. 9A.
Figure 10B:
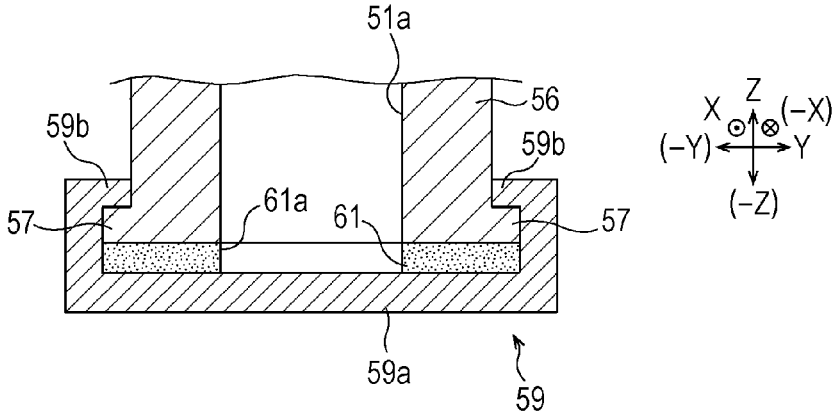
FIG. 10B is a sectional view of the inner-shutter support taken along line XB-XB in FIG. 9B.

FIG. 10A is a sectional view of an inner-shutter support 56 according to the present exemplary embodiment taken along line XA-XA in FIG. 9A. FIG. 10B is a sectional view of the inner-shutter support 56 taken along line XB-XB in FIG. 9B.

Referring to FIGS. 9A to 10B, the inner-shutter support 56, which is an example of a support member for an outlet cover member, is formed so as to project radially outward at the outer surface side of the outlet 51*a* at the back end of the cartridge body 51. As illustrated in FIG. 10B, the inner-shutter support 56 is provided with inner shutter guides 57, which are examples of guide portions, at the left and right sides thereof. The inner shutter guides 57 protrude outward in the left-right direction.

Referring to FIGS. 9B and 9C, lock cancelling portions 58, which are examples of opening-closing-member releasing portions, are formed at the front end of the inner-shutter support 56, that is, at the downstream end thereof in the direction in which the cartridge K is detached. In the present exemplary embodiment, the lock cancelling portions 58 are formed so as to extend from the inner shutter guides 57 at the front ends thereof, and provides the function of the inner shutter guides 57. In other words, the lock cancelling portions 58 according to the present exemplary embodiment are formed integrally with the inner shutter guides 57 and function also as the inner shutter guides 57.

Referring to FIGS. 9B and 9C, the inner shutter 59, which is an example of an outlet cover member or a first opening-closing member on a container, is supported by the inner shutter guides 57 such that the inner shutter 59 is movable in the front-back direction. The inner shutter 59 includes a plate-shaped inner shutter body 59*a*, which is an example of a first opening-closing member body. Inner guide portions 59*b*, which are examples of guided portions, are formed at the left and right sides of the inner shutter body 59*a*. The inner guide portions 59*b* extend in the front-back direction and are guided by the inner shutter guides 57. Thus, the inner shutter 59 according to the present exemplary embodiment is supported so as to be movable between the closed position illustrated in FIG. 9B at which the outlet 51*a* is closed and the open position illustrated in FIG. 9C at which the outlet 51*a* is open.

Left and right notched portions 59*c*, which are examples of releasing-portion receivers, are formed at the front end of the inner shutter body 59*a*. The notched portions 59*c* are formed so as to correspond to the lock cancelling portions 58 such that the lock cancelling portions 58 are outwardly exposed at the notched portions 59*c*. Referring to FIGS. 9B and 10A, an outer-shutter-guide extending portion 59*d*, which is an example of a second opening-closing member guide portion, is formed between the notched portions 59*c*. When the inner shutter 59 is at the position for closing the outlet 51*a*, the outer-shutter-guide extending portion 59*d* projects forward beyond a front edge of the inner-shutter support 56.

The inner shutter 59 according to the present exemplary embodiment is configured to be placed between the locking arms 33 when the cartridge K is attached to the cartridge holder KS. Accordingly, the width of the inner shutter 59 in the left-right direction corresponds to the distance between the locking arms 33. In addition, with regard to the length of the inner shutter 59 in the front-back direction, the distance from the back end of the inner shutter 59 to the back ends of the notched portions 59*c* corresponds to the distance from the front end of the main-body sealing member 36 to the back end faces 34*b* of the locking claws 34. The thickness of the main body 59*a* of the inner shutter 59 is set such that the top surface of the main body 59*a* of the inner shutter 59 is flush with the top surface of the main-body sealing member 36.

Referring to FIGS. 9A to 10B, a cartridge sealing member 61, which is an example of a container leakage preventing member, is provided between the outer surface of the inner-shutter support 56 and the inner shutter 59. The cartridge sealing member 61 is made of an elastic material, and prevents leakage of the developer through a gap between the inner shutter 59 and the inner-shutter support 56. As illustrated in FIG. 9C, an opening 61*a* which corresponds to the outlet 51*a* is formed in the cartridge sealing member 61 at a central area thereof. The shape of the cartridge sealing member 61 according to the present exemplary embodiment corresponds to the shape of the inner shutter 59. The cartridge sealing member 61 is not provided in areas corresponding to the notched portions 59*c* in the inner shutter 59, that is, in the areas corresponding to the lock cancelling portions 58.

In the present exemplary embodiment, the vertical distance from the top surfaces of the inner shutter guides 57 to the bottom surface of the cartridge sealing member 61 corresponds to the vertical distance from the bottom surfaces of the main-body shutter guides 24 to the top surface of the main-body sealing member 36. In addition, the width of the inner-shutter support 56 in the left-right direction is smaller than the distance between the narrowing portions 29 of the main-body-shutter holder 21, and the distance between the outer ends of the inner shutter guides 57 in the left-right direction is smaller than the distance between the main-body shutter guides 24. Accordingly, when the cartridge K is attached to the cartridge holder KS, the inner shutter guides 57 are guided by the main-body shutter guides 24 and the inner-shutter support 56 is placed in the main-body-shutter holder 21. As a result, the outlet 51*a* is connected to the inlet 23.

Referring to FIGS. 9A to 10B, a cartridge contact portion 62, which is an example of a container contact member and is also an example of a container engagement member, is formed so as to project radially outward from the outer peripheral surface of the cartridge body 51 at a position behind the inner-shutter support 56. The cartridge contact portion 62 substantially has the shape of a letter 'U' that faces backward, and includes a front end portion 62*a* that extends in the left-right direction and insertion portions 62*b* that extend backward from the left and right ends of the front end portion 62*a*. The insertion portions 62*b* are formed such that outer side surfaces thereof in the left-right direction are inclined inward in the left-right direction toward the back.

The size of the cartridge contact portion 62 according to the present exemplary embodiment is set such that the cartridge contact portion 62 may be placed in the main-body contact portion 39 of the main-body shutter 37. The length of the front end portion 62*a* in the left-right direction is smaller than the distance between the arms 39*b* and larger than the distance between the inner ends of the inner claw portions 39*d*. The distance between the back ends of the insertion portions 62*b*, that is, the downstream end thereof in the direction in which the cartridge K is attached, is smaller than the distance between the inner ends of the inner claw portions 39*d*.

Description of Outer Shutter and Guides Thereof

Referring to FIGS. 8A to 8E and 9A to 9C, a releasing rib 63, which is an example of a releasing member and which is also an example of a second-opening-closing-member stopper, is formed on the outer surface of the cartridge body 51. The releasing rib 63 is on the right side of the inner-shutter support 56 and extends in the front-back direction. In the present exemplary embodiment, the releasing rib 63 also has a function of covering an opening at the right side of the outer shutter 67, as described below. The releasing rib 63 is arranged at a position corresponding to the guide surface 45*a* and the contact surface 45*b* of the releasing block 45, and has a width smaller than that of the guide surface 45*a* and the contact surface 45*b*. The dimension of the releasing rib 63 according to the present exemplary embodiment in the left-right direction is set such that the releasing rib 63 may pass through a gap formed between the front plate 41*a* of the lock support portion 41 and a right wall 11*a* of the holder body 11 illustrated in FIGS. 4B and 4C.

The releasing rib 63 according to the present exemplary embodiment is an example of a projecting portion, and projects from the outer surface of the cartridge body 51. A contact portion 63*a* that may come into contact with the surfaces 45*a* and 45*b* is formed at the end of the releasing rib 63.

As illustrated in FIGS. 9B, 9C, and 10A, an outer-shutter back guide 64, which is also an example of a second opening-closing member guide portion, is formed at the back end of the cartridge body 51. The outer-shutter back guide 64 protrudes backward in an arc shape along the cartridge body 51. In FIG. 9C, an outer-shutter front guide 66, which is also an example of a second opening-closing member guide portion, is formed at a position on the left of the inner-shutter support 56. The outer-shutter front guide 66 is formed in an ark shape on the extension of the outer-shutter-guide extending portion 59*d* in the circumferential direction. A right end 66*a* of the outer-shutter front guide 66 is located at a position separated from the inner-shutter support 56 in the circumferential direction of the cartridge body 51 so that the outer-shutter front guide 66 does not interfere with the movement of the inner shutter 59.

Referring to FIGS. 9A to 10A, the outer shutter 67, which is an example of an outlet cover member or a second opening-closing member on a container, is supported by the outer shutter guides 64, 66, and 59*d*. The outer shutter 67 includes an outer shutter body 67*a*, which is an example of a main body of the second opening-closing member. The outer shutter body 67*a* has a partial cylindrical shape that extends along the outer peripheral surface of the cartridge body 51. Outer-shutter guide portions 67*b*, which are examples of guided portions, are formed at the front and back ends of the outer shutter body 67*a*. The outer-shutter guide portions 67*b* are guided by the outer-shutter guides 64, 66, and 59*d*. Thus, the outer shutter 67 is supported so as to be moveable along the outer-shutter guides 64, 66, and 59*d* in the circumferential direction of the cartridge body 51. The outer shutter 67 moves between the position for closing the outlet 51*a* illustrated in FIG. 9A, at which the outer shutter 67 covers both the outlet 51*a* and the inner shutter 59, and the position for opening the outlet 51*a* illustrated in FIG. 9B, at which the outer shutter 67 does not cover the inner shutter 59.

As illustrated in FIG. 9A, an outer-shutter opening-closing projection 67*c*, which is an example of a contact body, is formed on the outer surface of the outer shutter 67 so as to project outward. The outer-shutter opening-closing projection 67*c* is formed so as to correspond to the cartridge shutter passage 12, and is capable of coming into contact with the inner side surfaces of the projection guide grooves 14 and 16.

The cartridge K, which is an example of a developer container according to the present exemplary embodiment, includes the components denoted by reference numerals 51 to 67. A developer transporting device RT+KS+K according to the present exemplary embodiment includes the transporting device body RT+KS and the cartridge K.

Operation of Exemplary Embodiment

In the copy machine U according to the present exemplary embodiment including the above-described components, a latent image formed on the surface of the photoconductor drum PR is developed by the developing device G in the developing area Q2. Thus, the developer in the developing device G is consumed. As the developer in the developing device G is consumed, the supplying auger 2 and the transporting system GH are operated to supply the developer from the cartridge K in accordance with the amount of consumption.

When, for example, all the developer in the cartridge K is supplied and the cartridge K becomes empty or when the cartridge K does not function properly, the cartridge K is replaced with a new cartridge K by pulling out the old cartridge K and inserting the new cartridge K in the front-back direction of the copy machine body U1.

Description of Cartridge Attaching Operation

Referring to FIGS. 3, 4, and 9A, when the cartridge K is inserted into the cartridge holder KS from the front, the outer-shutter opening-closing projection 67*c* on the outer shutter 67 moves backward along the cartridge shutter passage 12 and comes into contact with the bottom end of the first projection guide groove 14. Then, when the cartridge K is further inserted, the outer-shutter opening-closing projection 67*c* is guided along the first projection guide groove 14 so that the outer shutter 67 is moved upward along the circumferential direction of the cartridge body 51. Thus, when the cartridge K is inserted by being moved backward, the outer shutter 67 is moved in the circumferential direction from the position illustrated in FIG. 9A at which the outer shutter 67 covers the outlet 51*a* and the position illustrated in FIGS. 9B and 9C at which the outer shutter 67 does not cover the outlet 51*a*. As a result, the inner shutter 59 is exposed.

Figures 11A, 11B:
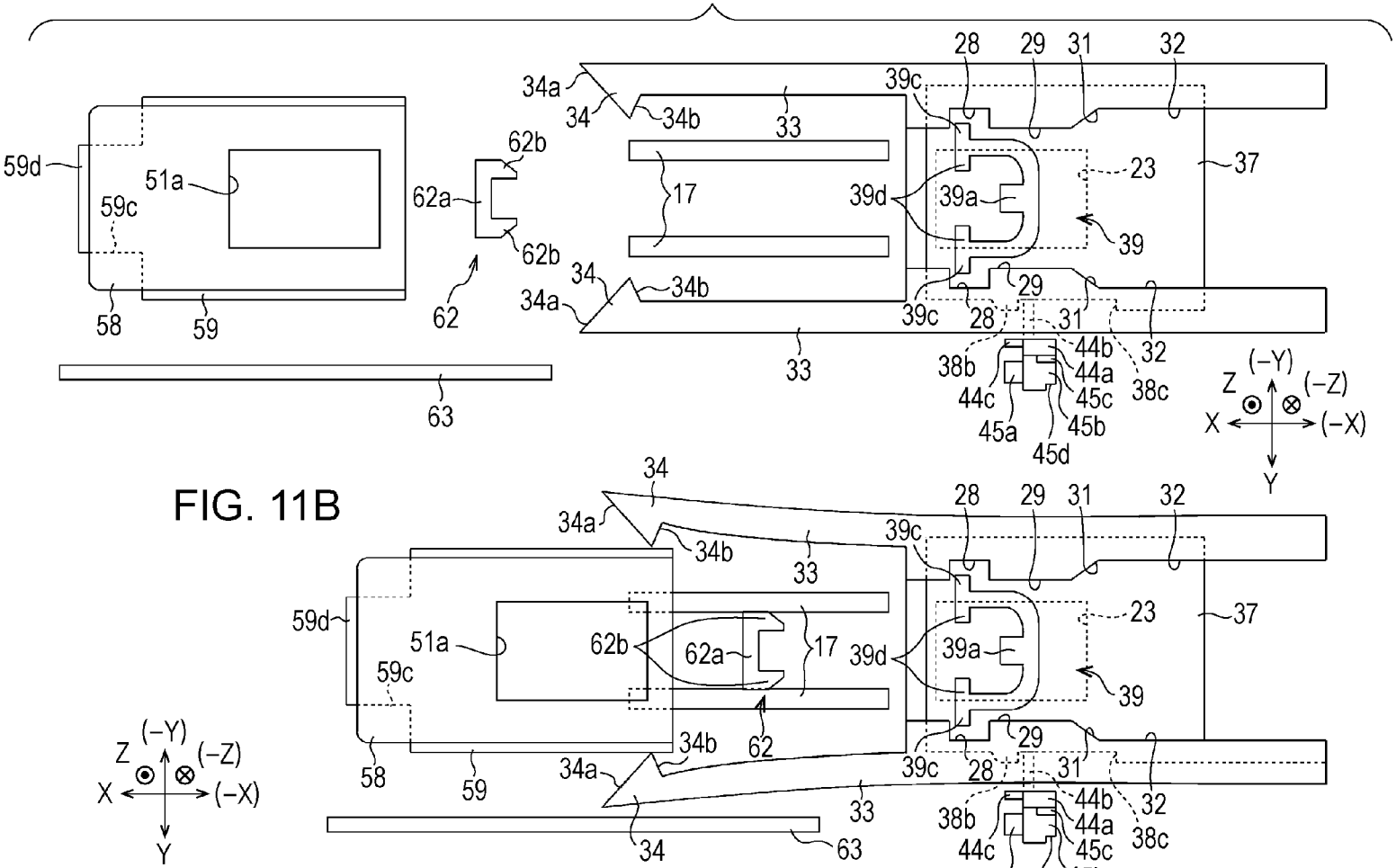

FIGS. 11A and 11B illustrate the states of the main-body shutter 37, the inlet 23, the main-body-shutter lock 43, the cartridge inner shutter 59, the inner-shutter support 56, the cartridge contact portion 62, the releasing rib 63, and a container shutter lock in the process of attaching the cartridge K according to the present exemplary embodiment to the main body. FIG. 11A illustrates the state in which the cartridge K is separated from the main body. FIG. 11B illustrates the state in which the cartridge K is inserted from the state illustrated in FIG. 11A to the state in which the cartridge inner shutter 59 is in contact with the container shutter lock.

Referring to FIGS. 11A and 11B, when the cartridge K is further inserted into the main body while the inner shutter 59 is exposed, the inner shutter 59 in the state illustrated in FIG. 11A approaches the main-body-shutter holder 21. Then, the cartridge contact portion 62 moves backward through the space between the locking claws 34, and the back end of the inner shutter 59, that is, the downstream end thereof in the direction in which the cartridge K is attached, comes into contact with the front guide surfaces 34*a* of the locking arms 33. Then, when the cartridge K in this state is further inserted, the locking arms 33 are elastically deformed outward, as illustrated in FIG. 11B. Accordingly, the inner shutter 59 and the inner-shutter support 56 on the cartridge K may be moved further backward.

Figure 12A:
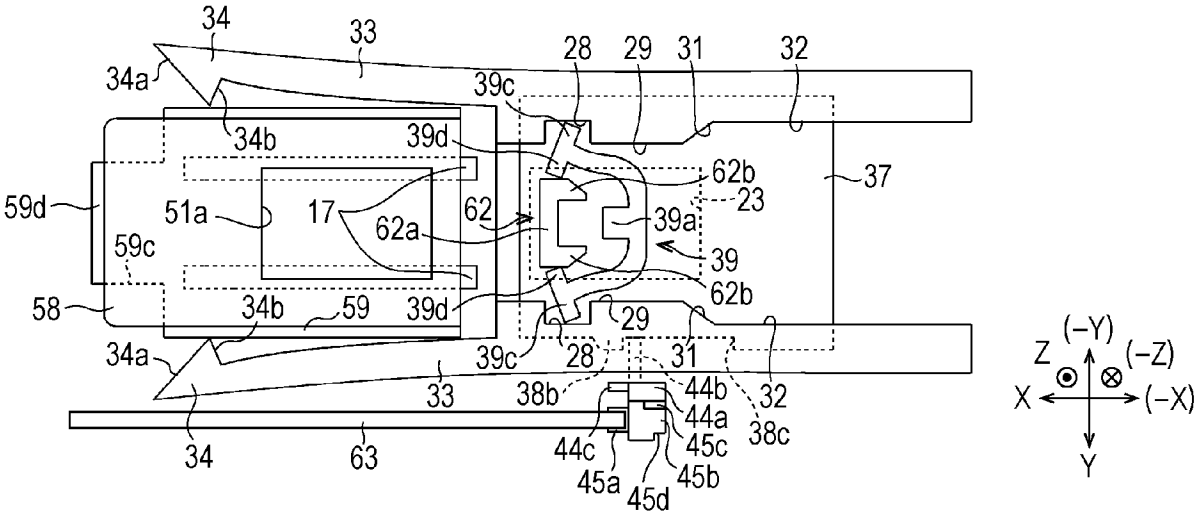
Figure 12B:
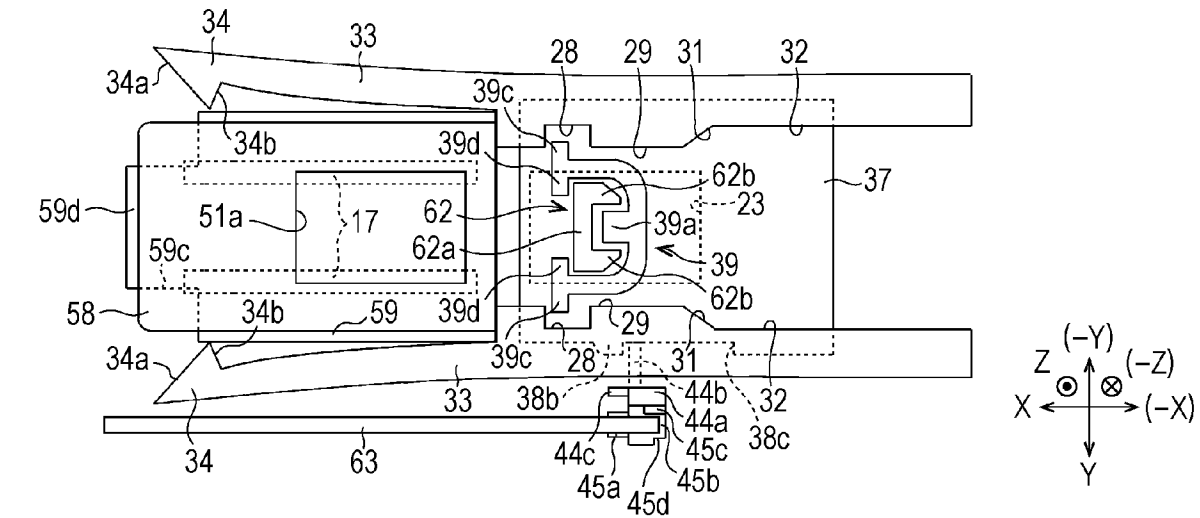

FIGS. 12A and 12B illustrate the states after the states in FIGS. 11A and 11B. FIG. 12A illustrates the state in which the cartridge K is further inserted from the state illustrated in FIG. 11B and the cartridge contact portion 62 is in contact with the main-body contact portion 39. FIG. 12B illustrates the state in which the cartridge K is further inserted from the state illustrated in FIG. 12A and the cartridge contact portion 62 is placed in the main-body contact portion 39.

When the cartridge K is further moved backward from the state illustrated in FIG. 11B, the bottom surface of the inner shutter 59 is guided and pushed upward by the rattling preventing ribs 17. Accordingly, rattling in the up-down direction is suppressed and the inner shutter 59 is positioned in the up-down direction. When the cartridge contact portion 62 reaches the main-body contact portion 39, the insertion portions 62*b* of the cartridge contact portion 62 are inserted into the space between the inner claw portions 39*d* and try to push the engaging arms 39*b* away from each other. At this time, the outer claw portions 39*c* are placed in the recesses 28 in the main-body-shutter holder 21, and are therefore allowed to move outward in the left-right direction. Therefore, as illustrated in FIG. 12A, the engaging arms 39*b* are elastically deformed and pushed outward.

At this time, the releasing rib 63 is in contact with the guide surface 45*a* of the main-body-shutter lock 43, and the state illustrated in FIG. 8A is established. As the releasing rib 63 is moved rearward, the guide surface 45*a* is pushed by the releasing rib 63. Accordingly, owing to the inclination of the guide surface 45*a*, the main-body-shutter lock 43 is moved downward against the elastic force of the lock spring 46 from the stopping position illustrated in FIG. 8A toward the releasing position illustrated in FIG. 8C.

Then, when the cartridge K is further inserted backward from the state illustrated in FIG. 12A and the cartridge contact portion 62 is placed in the main-body contact portion 39, the engaging arms 39*b* elastically restore their original shapes, as illustrated in FIG. 12B. Accordingly, the inner claw portions 39*d* face each other in front of the front face of the front end portion 62*a* of the cartridge contact portion 62. Thus, the cartridge contact portion 62 is restrained from moving with respect to the main-body shutter 37. In other words, the cartridge contact portion 62 is locked.

At this time, the releasing rib 63 is moved to the contact surface 45*b* beyond the guide surface 45*a*, and the main-body-shutter lock 43 is moved to the releasing position. Accordingly, the main-body shutter 37 is released from the locked state and is movable toward the position for opening the inlet 23.

When the cartridge K is further moved backward from the state illustrated in FIG. 12B, the cartridge contact portion 62 pushes the main-body contact portion 39 and the main-body shutter 37 moves backward. More specifically, the main-body shutter 37 moves from the position for closing the inlet 23 to the position for opening the inlet 23. When the back end of the inner shutter 59 comes into contact with the front end of the main-body sealing member 36, the movement of the inner shutter 59 stops. Accordingly, only the inner-shutter support 56 moves backward together with the cartridge K. In other words, the inner shutter 59 relatively moves from the position for closing the outlet 51*a* to the position for opening the outlet 51*a*.

Figure 13A:
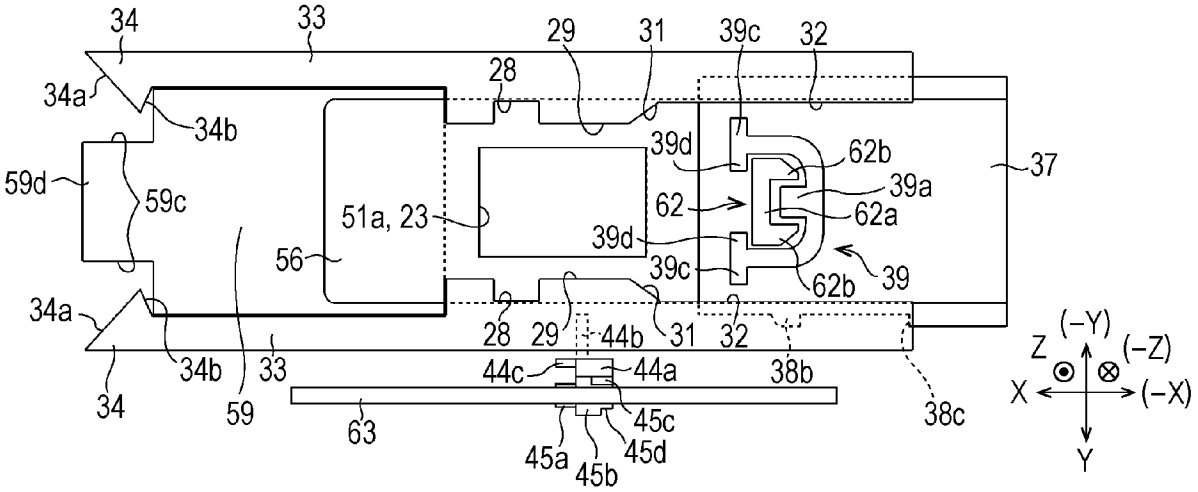
Figure 13B:
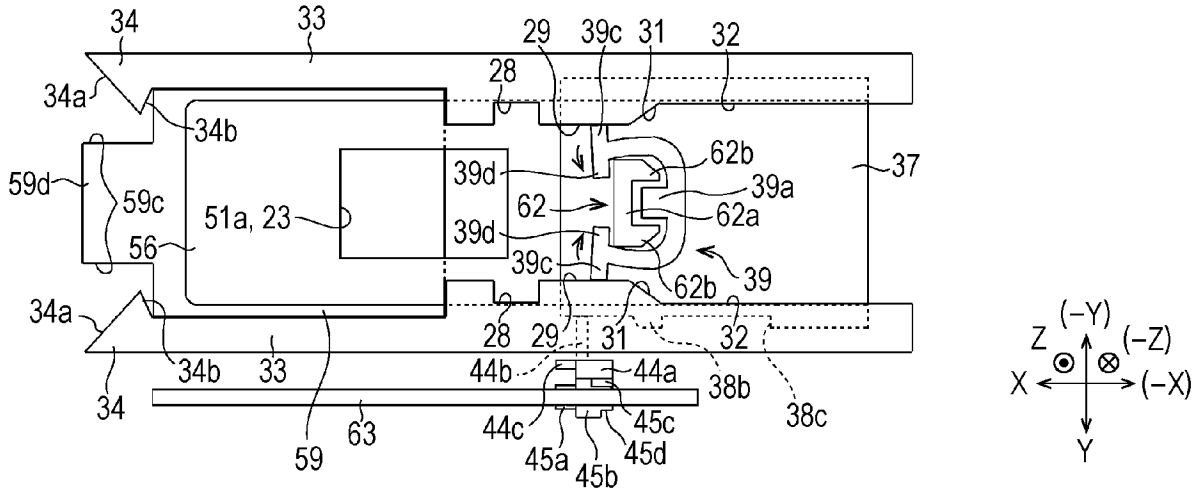

FIGS. 13A and 13B illustrate the states after the states in FIGS. 12A and 12B. FIG. 13A illustrates the state in which the cartridge K is further inserted from the state illustrated in FIG. 12B and the insertion of the cartridge K is completed. FIG. 13B illustrates the state in which the cartridge K is pulled outward from the state illustrated in FIG. 13A and deformation of the main-body contact portion 39 is suppressed.

Referring to FIG. 13A, when the cartridge K is inserted to the deepest position, as illustrated in FIG. 3, the shutters 37 and 57 are moved to the respective open positions, and the outlet 51*a* and the inlet 23 are connected to each other, as illustrated in FIG. 13A. In this state, the developer may be supplied from the cartridge K to the reservoir tank RT.

In the state illustrated in FIG. 13A, the inner-shutter support 56 of the cartridge K is moved backward such that the lock cancelling portions 58 are separated from the notched portions 59*c* in the inner shutter 59. Accordingly, as illustrated in FIG. 13A, the locking claws 34 are released from the lock cancelling portions 58 and the locking arms 33 restore their original shapes such that the notched portions 59*c* are placed between the locking claws 34. In this state, movement of the inner shutter 59 in the front-back direction is restrained by the locking arms 33. In other words, the inner shutter 59 is locked by the locking arms 33.

Description of Cartridge Detaching Operation

When, for example, the cartridge K becomes empty and the cartridge K is to be removed, the cartridge K is pulled forward. When the cartridge K is pulled forward from the state illustrated in FIG. 13A, the inner shutter 59 is locked by the locking claws 34 of the locking arms 33 and cannot move. Accordingly, only the inner-shutter support 56 moves forward together with the cartridge K. Thus, the locking arms 33 relatively move the inner shutter 59 to the position for closing the outlet 51*a*. At this time, the cartridge contact portion 62 is also locked by the main-body contact portion 39, so that the main-body contact portion 39 is also pulled forward as the cartridge contact portion 62 on the cartridge K is moved forward. As a result, the main-body shutter 37 is also moved forward, that is, toward the position for closing the inlet 23.

When the main-body shutter 37 is moved forward, the engaging arms 39*b* of the main-body contact portion 39 receive a force that tries to push the engaging arms 39*b* away from each other from the cartridge contact portion 62 that moves forward. However, in the present exemplary embodiment, the distance between the outer ends of the outer claw portions 39*c* corresponds to the distance between the broadening portions 32. Accordingly, even when the engaging arms 39*b* try to expand outward, the outer claw portions 39*c* come into contact with the broadening portions 32 and the engaging arms 39*b* cannot expand outward. Thus, the cartridge contact portion 62 is prevented from being pulled out from the main-body contact portion 39.

When the cartridge K is further pulled forward, the outer claw portions 39*c* of the main-body contact portion 39 come into contact with the inclined portions 31 and the narrowing portions 29, so that the engaging arms 39*b* receive a force that pushes the engaging arms 39*b* inward. Accordingly, the cartridge contact portion 62 is reliably prevented from being pulled out from the main-body contact portion 39. Therefore, in the present exemplary embodiment, the risk that the contact portions 39 and 62 will be disengaged from each other and the main-body shutter 37 will be stopped at the position for opening the inlet 23 or an intermediate position before the main-body shutter 37 returns to the position for closing the inlet 23.

Figure 14:
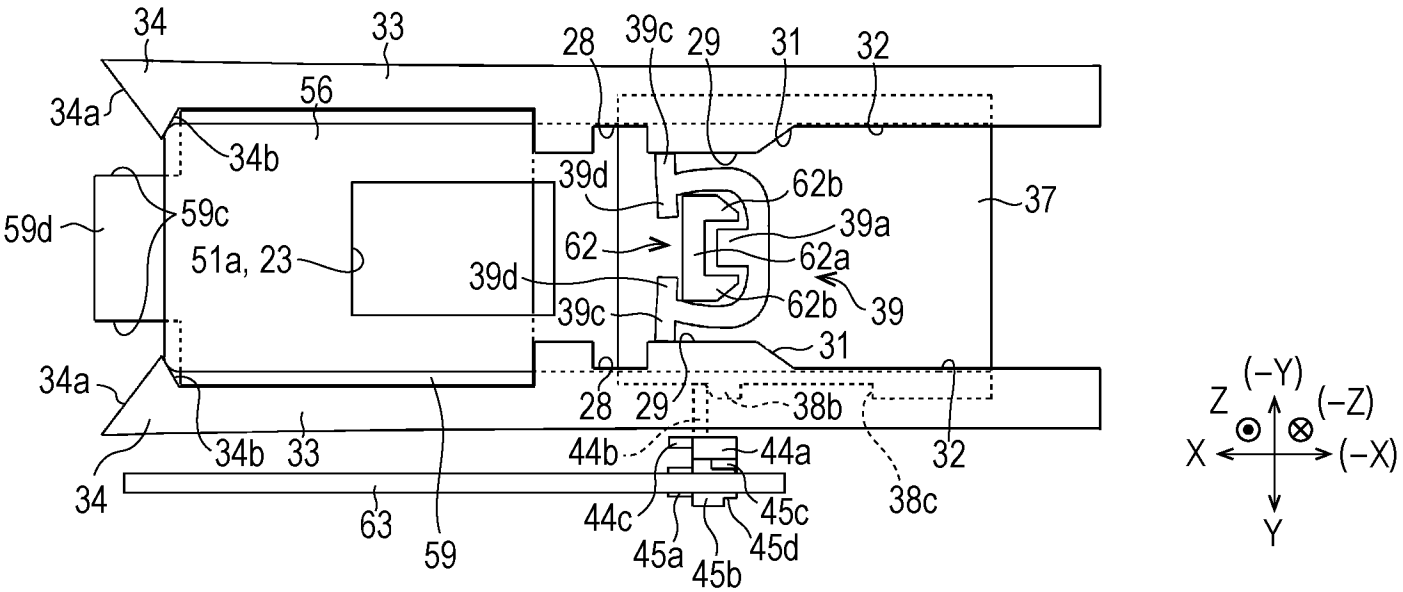
FIG. 14 illustrates the state after the state in FIG. 13B, in which the cartridge is further pulled outward from the state illustrated in FIG. 13B and lock cancelling portions are in contact with an inner shutter lock.

FIG. 14 illustrates the state after the state in FIG. 13B, in which the cartridge K is further pulled outward from the state illustrated in FIG. 13B and the lock cancelling portions 58 are in contact with the inner shutter lock.

When the cartridge K is moved forward from the state illustrated in FIG. 13B and reaches the position illustrated in FIG. 14, the lock cancelling portions 58 come into contact with the back end faces 34*b* of the locking claws 34. Then, when the cartridge K in this state is further moved forward, the locking claws 34 are pushed outward by the lock cancelling portions 58 and the locking arms 33 are elastically deformed outward. Accordingly, the state illustrated in FIG. 12B is established, so that the inner shutter 59 returns to the position for closing the outlet 51*a* and is released from the locked state. Then, as the cartridge K is moved forward, the inner shutter 59 is moved forward together with the inner-shutter support 56 while the outlet 51*a* is closed by the inner shutter 59.

When the cartridge K reaches the position illustrated in FIG. 12B, the main-body shutter 37 is moved to the position for closing the inlet 23 and the inlet 23 is closed by the main-body shutter 37. Then, forward movement of the main-body shutter 37 is restrained by a stopper (not shown). In this state, the outer claw portions 39*c* are at positions corresponding to the recesses 28, so that the engaging arms 39*b* are allowed to be elastically deformed outward. Therefore, when the cartridge K in the state illustrated in FIG. 12B is further moved forward, the engaging arms 39*b* are pushed away from each other, as illustrated in FIG. 12A, and the cartridge contact portion 62 is pulled out from the main-body contact portion 39. Accordingly, when the cartridge K is further moved forward, the cartridge K is set to the states illustrated in FIGS. 11B and 11A in that order, and then the outer shutter 67 is guided by the first projection guide groove 14 and is moved to the position for closing the outlet 51*a*. Thus, the cartridge K is detached while the outlet 51*a* in the cartridge K is closed by both the inner shutter 59 and the outer shutter 67 and the inlet 23 is closed by the main-body shutter 37.

In the copy machine U according to the present exemplary embodiment, when the cartridge K is removed, the main-body-shutter lock 43 is moved to the stopping position so that the main-body shutter 37 is locked and is restrained from moving to the position for opening the inlet 23. In the present exemplary embodiment, the main-body shutter 37 is locked by the main-body-shutter lock 43.

In particular, in the present exemplary embodiment, the main-body shutter 37 and the main-body-shutter lock 43 respectively include the main-body inclined surface 38*d* and the lock inclined surface 44*c*, which are inclined downward toward the back side, that is, toward the position for opening the inlet 23 or toward the releasing position. Therefore, when the main-body shutter 37 is pushed backward toward the position for opening the inlet 23, the main-body inclined surface 38*d* and the lock inclined surface 44*c* come into each other and the lock inclined surface 44*c* is pushed upward, that is, away from the releasing position. As a result, in the present exemplary embodiment, when the main-body shutter 37 is pushed toward the position for opening the inlet 23, the main-body-shutter lock 43 is moved in the direction away from the releasing direction, that is, in the direction for reinforcing the locked state. Thus, the risk that the main-body shutter 37 will be opened by accident is reduced.

In addition, in the cartridge K according to the present exemplary embodiment, when the releasing rib 63 for moving the main-body-shutter lock 43 to the releasing position is moved to the position at which the outer shutter 67 closes the outlet 51*a*, the releasing rib 63 is near and in contact with the outer shutter 67 and is connected to the right edge of the outer shutter 67. In other words, the releasing rib 63 is integrated with the outer shutter 67. Therefore, when the outer shutter 67 is moved to the position for closing the outlet 51*a*, even when the releasing rib 63 tries to come into contact with the guide surface 45*a* of the main-body-shutter lock 43, the back surface of the outer shutter 67 cannot pass through the gap between the front plate 41*a* of the lock support portion 41 and the right wall 11*a* of the holder body 11 since the back surface of the outer shutter 67 is wider than the gap. As a result, the back surface of the outer shutter 67, which is wider than the guide surface 45*a*, etc., interferes with other parts before the releasing rib 63 reaches the guide surface 45*a*. Thus, the releasing rib 63 cannot come into contact with the main-body-shutter lock 43 and the locked state cannot be canceled.

Therefore, if the cartridge K is inserted in an incorrect posture due to, for example, backlashes between the cartridge K and the holder body 11, the outer shutter 67 is not released from the position at which the outer shutter 67 closes the outlet 51*a*. As a result, the releasing rib 63 is prevented from being exposed and the locked state is not canceled.

In the present exemplary embodiment, the main-body shutter 37 is prevented from being opened by accident without increasing the manufacturing costs or the risk that the shutters 37, 59, and 69 cannot be moved.

In addition, in the present exemplary embodiment, the releasing rib 63 not only has a function of releasing the main-body-shutter lock 43 but also serves as a member for blocking the right side of the outer shutter 67. In the state in which the outer shutter 67 is at the position for closing the outlet 51*a*, the releasing rib 63 is substantially integrated with the outer shutter 67.

In the present exemplary embodiment, the direction in which the outer shutter 67 is moved crosses or is orthogonal or substantially orthogonal to the direction in which the cartridge K is attached or detached.

In the present exemplary embodiment, the direction in which the outer shutter 67 is opened or closed is set to the circumferential direction, which is orthogonal or substantially orthogonal to the direction in which the cartridge K is inserted, and the direction in which the main-body shutter 37 is opened or closed is along the direction in which the cartridge K is inserted. In addition, in the present exemplary embodiment, the releasing rib 63 extends along the direction in which the cartridge K is inserted.

In the present exemplary embodiment, the lock cancelling portions 58 are formed integrally with the inner shutter guides 57, and may be easily formed.

In addition, in the cartridge K according to the present exemplary embodiment, two shutters, which are the inner shutter 59 and the outer shutter 67, are provided. In the present exemplary embodiment, the lock cancelling portions 58 are provided on the inner-shutter support 56. In the cartridge K according to the present exemplary embodiment, the guide extending portion 59*d* is formed on the inner shutter 59.

Modifications

Although an exemplary embodiment of the present invention is described in detail above, the present invention is not limited to the above-described exemplary embodiment, and various modifications are possible within the scope of the present invention defined by the claims. Modifications (H01) to (H05) of the present invention will now be described below.

(H01) Although the copy machine U is described as an example of an image forming apparatus in the above-described exemplary embodiment, the image forming apparatus is not limited to this, and may instead be, for example, a printer, a facsimile machine, or a multifunction machine having the functions of these machines. In addition, the image forming apparatus is also not limited to a monochrome image forming apparatus, and may instead be a multicolor image forming apparatus.

(H02) In the above-described exemplary embodiment, the cartridge K that contains fresh developer that is to be supplied to the developing device G is described as an example of a developer container. However, the developer container is not limited to this, and may instead be, for example, a waste toner box that contains developer that is collected from the photoconductor cleaner CLp or the belt cleaner CLb. The present invention may be applied to a portion of, for example, a detachable developing device G or the like that serves as a container that contains developer therein and that is detachably attached to the transporting device body in the image forming apparatus.

(H03) In the above-described exemplary embodiment, the lock cancelling portions 58 are formed integrally with the inner shutter guides 57. However, the lock cancelling portions are not limited to this, and may instead be configured such that the lock cancelling portions do not serve as the inner shutter guides but as stoppers that prevent the inner shutter 59 from being detached, or such that the lock cancelling portions do not provide any function other than the lock cancelling function.

(H04) In the above-described exemplary embodiment, the releasing rib 63, which is the member for releasing the main-body-shutter lock 43, also has a function of stopping the outer shutter 67 and blocking the right side surface of the outer shutter 67. However, the releasing member is not limited to this, and may instead be a member other than the member for blocking the right side surface. For example, a protrusion or a rib arranged between the releasing rib 63 and the outlet 51*a* may be used as the releasing member. In this case, the releasing member is covered by the outer shutter 67 when the outer shutter 67 is at the position for closing the outlet 51*a*, and the risk that the locked state will be canceled by accident may be further reduced.

(H05) In the above-described exemplary embodiment, the structures of the main-body-shutter holder 21, the main-body contact portion 39, the cartridge contact portion 62, etc., are not limited to the above-described structures, and may be changed as appropriate in accordance with the design, usage, and other factors. For example, although the locking arms 33, the engaging arms 39*b*, the insertion portions 62*b*, etc., are provided in pairs to be arranged at the left and right sides, these components may instead be provided at only one of the left and right sides.

(H06) In the above-described exemplary embodiment, the length of the releasing rib 63 used as the releasing member may be changed arbitrarily in accordance with, for example, the design. In addition, although the releasing rib 63 is a single rib that extends in the front-back direction in the above-described example, the releasing member is not limited to this. For example, the releasing member may be such that plural projections or bosses or plural ribs having a small length in the front-back direction are arranged only in an area corresponding to the time when the main-body-shutter lock 43 is to be moved to the releasing position.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer transporting device comprising:

a transporting device body having an inlet through which developer is supplied to the transporting device body;

an inlet cover member that opens and closes the inlet;

a container having an outlet through which developer contained in the container is discharged, the container being detachably supported by the transporting device body;

an outlet cover member that opens and closes the outlet;

a restraining member that is provided on the transporting device body and that restrains an opening movement of the inlet cover member; and a releasing member that is provided on the container and that is capable of releasing the inlet cover member from the state in which the opening movement is restrained, wherein the restraining member restrains the opening movement of the inlet cover member when the outlet cover member is closed, and the releasing member releases the inlet cover member from the state in which the opening movement is restrained when the outlet cover member is open.

2. The developer transporting device according to claim 1, wherein the releasing member includes a projecting portion that projects from the container, the outlet cover member is moved away from the projecting portion when the outlet cover member is moved to open the outlet, the restraining member has a gap that allows the projecting portion to pass therethrough and a contacting portion, and the projecting portion passes through the gap and comes into contact with the contacting portion so that the first cover member is released from the state in which the opening movement is restrained.

3. The developer transporting device according to claim 2, wherein the projecting portion is disposed along a direction in which the container is inserted, and the gap in the restraining member extends along the direction in which the container is inserted.

4. The developer transporting device according to claim 2, wherein the restraining member includes a protrusion that protrudes from the contacting portion, and the protrusion comes into contact with an adjacent member that is disposed adjacent to the protrusion and restrains a posture of the restraining member when the releasing member releases the inlet cover member from the state in which the opening movement is restrained by the restraining member.

5. The developer transporting device according to claim 3, wherein the restraining member includes a protrusion that protrudes from the contacting portion, and the protrusion comes into contact with an adjacent member that is disposed adjacent to the protrusion and restrains a posture of the restraining member when the releasing member releases the inlet cover member from the state in which the opening movement is restrained by the restraining member.

6. The developer transporting device according to claim 1, wherein the outlet cover member is moved in a direction substantially orthogonal to a direction in which the container is inserted.

7. The developer transporting device according to claim 2, wherein the outlet cover member is moved in a direction substantially orthogonal to a direction in which the container is inserted.

8. The developer transporting device according to claim 3, wherein the outlet cover member is moved in a direction substantially orthogonal to a direction in which the container is inserted.

9. The developer transporting device according to claim 4, wherein the outlet cover member is moved in a direction substantially orthogonal to a direction in which the container is inserted.

10. The developer transporting device according to claim 5, wherein the outlet cover member is moved in a direction substantially orthogonal to a direction in which the container is inserted.

11. An image forming apparatus comprising:

an image carrier that rotates;

a developing device that forms a visible image by developing a latent image formed on a surface of the image carrier;

a transfer device that transfers the visible image from the surface of the image carrier to a medium;

a fixing device that fixes the visible image that has been transferred onto the medium; and the developer transporting device according to claim 1, the developer transporting device transporting the developer to the developing device.

12. The developer transporting device according to claim 1, further comprising an inner cover that covers the outlet of the container and opens the outlet when moved in a direction in which the container is inserted, wherein the outlet cover member covers the inner cover.

13. The developer transporting device according to claim 1, wherein the releasing member is disposed outside guide members that guide movement of the inlet cover member.

14. The developer transporting device according to claim 1, wherein the releasing member is provided on the container distant from the outlet cover member.

* * * * *